US010046887B2

(12) United States Patent
Azelton et al.

(10) Patent No.: US 10,046,887 B2
(45) Date of Patent: Aug. 14, 2018

(54) CONTAINER WITH LOCKING LID

(71) Applicant: THE CLOROX COMPANY, Oakland, CA (US)

(72) Inventors: Kerry D. Azelton, Pleasanton, CA (US); Ryan Christian, Morgan Hill, CA (US); Brian Crane, Morgan Hill, CA (US); Vince N. DeMaso, Pleasanton, CA (US); Gary Hulme, Morgan Hill, CA (US); Gwen H. Lorio, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 30 days.

(21) Appl. No.: 15/189,911

(22) Filed: Jun. 22, 2016

(65) Prior Publication Data

US 2017/0369213 A1 Dec. 28, 2017

(51) Int. Cl.
*B65D 43/26* (2006.01)
*B65D 43/02* (2006.01)

(52) U.S. Cl.
CPC ..... *B65D 43/26* (2013.01); *B65D 43/0225* (2013.01); *B65D 2543/00833* (2013.01)

(58) Field of Classification Search
CPC ..... B65D 41/0485; B65D 2543/00833; B65D 43/26; B65D 43/0225
USPC ..... 220/324
See application file for complete search history.

(56) References Cited

U.S. PATENT DOCUMENTS

| | | | | |
|---|---|---|---|---|
| 3,917,097 | A * | 11/1975 | Uhlig | B65D 50/046 215/216 |
| 4,613,051 | A * | 9/1986 | Swartzbaugh | B65D 50/046 215/225 |
| 4,687,112 | A | 8/1987 | Swartzbaugh | |
| 5,312,010 | A | 5/1994 | Johnson | |
| 5,803,287 | A | 9/1998 | Kusz | |
| 5,908,125 | A | 6/1999 | Opresco | |
| 6,039,196 | A | 3/2000 | Ekkert et al. | |
| 6,296,130 | B1 | 10/2001 | Forsyth et al. | |
| 6,763,960 | B2 | 7/2004 | Oh | |
| 7,193,515 | B1 | 3/2007 | Roberts et al. | |
| 7,641,064 | B2 | 1/2010 | Robinson | |
| 7,938,282 | B1 * | 5/2011 | Hawry | B65D 41/0485 215/305 |
| 8,240,491 | B2 | 8/2012 | Beecroft et al. | |
| 8,371,463 | B2 | 2/2013 | Beecroft | |
| 8,528,772 | B1 | 9/2013 | Morris, Jr. | |
| 2004/0195241 | A1 | 10/2004 | Stull et al. | |

(Continued)

FOREIGN PATENT DOCUMENTS

WO 2003086894 A1 10/2003

*Primary Examiner* — Jeffrey Allen
(74) *Attorney, Agent, or Firm* — Alok Goel

(57) ABSTRACT

In one example, a lid configured for use with a container includes an upper surface that is generally circular in shape, and further includes a side wall with an annular configuration, the side wall intersecting the upper surface to define an edge of the lid. A grip element is defined in the upper surface and sized and configured to be grasped by one or more fingers of a user, and the grip element includes a grip portion that is set back a distance from the edge of the lid. Finally, a tab is provided that is attached to the side wall of the lid by an elastically deformable standoff element.

16 Claims, 26 Drawing Sheets

(56) References Cited

U.S. PATENT DOCUMENTS

| | | | | |
|---|---|---|---|---|
| 2008/0251531 | A1 | 10/2008 | Coe et al. | |
| 2015/0048113 | A1 * | 2/2015 | Brannon | B65D 47/40<br>222/109 |

* cited by examiner

CONTAINER WITH LOCKING LID

FIELD OF THE INVENTION

Embodiments of the present invention generally concern containers that can be used to hold a variety of materials. More particularly, at least some embodiments of the invention relate to a bottle including a relatively large diameter lid configured so that it can be operated relatively easily by users who may have limited hand strength and mobility.

BACKGROUND

A variety of containers exist that include a relatively large opening that is sized to accommodate part or all of the hand of a user, a scoop, or other item. Such containers are often used for dry materials such as bulk detergent and detergent pods for example. The relatively large opening of the container enables a user to grasp an item such as a detergent pod that is in the container, or to scoop out a desired amount of product such as bulk detergent.

While containers such as those just described have proved useful in various applications, various problems remain in the art. A number of such problems relate to the configuration and operation of the lid. For example, while a wide mouth bottle configuration is desirable in some circumstances, such a configuration often necessitates the use of a correspondingly large diameter lid. However, such large diameter lids may be difficult to operate for users with relatively small hands, limited hand strength, arthritis, or other conditions. Particularly, such individuals can find it difficult to firmly grasp, and then turn, the lid until the lid is removed from the container. Such individuals can encounter similar difficulties when attempting to secure the lid back on the container after use.

Yet other problems in the art relate to the fact that some lids of wide mouth containers are not lockable. Thus, a child may in some cases be able to remove the lid from the container and access the contents of the container. This circumstance is of particular concern in cases where the material in the container could cause harm or damage if ingested or otherwise misused. For example, a curious child might be inclined to put a detergent pod in his or her mouth.

Finally, even where a lockable lid is provided, such lids can be difficult to operate for users with relatively small hands, limited hand strength, arthritis, or other conditions. This may be due both to the relatively large diameter of the lid, and also to the nature of the locking mechanism employed. For example, some locking mechanisms require the user to firmly grasp the lid with both the fingers and thumb of one hand in order to be able to operate the locking mechanism. However, this operation can be difficult to perform for users with conditions such as those mentioned above.

In light of problems such as those noted above, it would be useful to provide a container having a relatively large diameter lid that can be operated by a user who may have relatively small hands, limited hand strength, arthritis, and/or other conditions that would make it difficult to operate a conventional large diameter lid. Further, it would be useful to provide a relatively large diameter lid that can be operated by a user using only the fingers, and not the thumb, of the user. As well, it would be useful to provide a container lid that is configured so that it does not require the hand of a user to span the entire diameter of the lid in order for the user to attach and remove the lid. It would be useful to provide a relatively large diameter lid that is lockable. Finally, it would be useful to provide a relatively large diameter lid that can be fully seated on, and unseated from, a container body with less than one turn of the lid.

ASPECTS OF AN EXAMPLE EMBODIMENT

Embodiments within the scope of the invention may be effective in overcoming one or more of the problems in the art, although it is not required that any embodiment resolve any particular problem(s). In general, embodiments of the present invention concern containers that can be used to hold a variety of different types and forms of materials. The scope of the invention is not limited to any type or form of materials. Some embodiments of the container can include a relatively large diameter lid that is lockable on the container and which is configured so that it can be operated relatively easily by users who may have limited hand strength and mobility. Embodiments that include a locking lid may be referred to herein as a Child Resistant Container (CRC). In other, non-CRC, embodiments, the lid does not lock onto the container.

In one particular embodiment, the lid is internally threaded and includes one or more grip elements in the form of a recess or raised portion that is located in the upper surface away from the edge of the lid. The recess or raised portion is sized and configured to accommodate fingertips of a user. Locking embodiments of the lid can include a locking element, such as tab that is located opposite the recess and that is attached to the side of the lid by one or more elastically deformable standoff elements that position the tab a distance away from the side of the lid. The inner side of the tab faces toward the lid and includes an engagement element configured to releasably engage corresponding engagement elements on the neck of the container. The neck of the container also includes external threads configured to engage the threads inside the lid. In embodiments where the lid is not lockable to the container, the tab and engagement elements can be omitted from the lid, and the engagement elements can be omitted from the container.

To attach the lid to the container, the user can grasp the grip element and the tab between her fingertips and palm, and then simply rotate the lid until it is fully seated on the container. As the lid is rotated to this closed position, the engagement element of the lid is moved into a gap between engagement elements of the container, thus preventing rotation of the lid in the reverse direction. To remove the lid, the user can grasp the lid as before, while also squeezing the tab. Because the standoff elements that attach the tab to the lid are elastically deformable, the bottom of the tab, where the engagement element is located, is rotated out away from the neck of the container, so that it is disengaged from the engagement elements of the container. When the respective engagement elements are thus disengaged, the lid is free to rotate relative to the container and can be removed.

Advantageously then, embodiments of the invention are directed to a container and lid that may enable a user to readily attach and remove the lid of the container, even if the user has relatively small hands, limited hand strength, arthritis, and/or other conditions that would otherwise make it difficult to operate a lid having a relatively large diameter. As well, where a locking lid is provided, such users may find it relatively easy to lock and unlock the lid, and the locking feature of the lid may prevent small children from accessing the contents of the container. Some example embodiments of the invention can be used in connection with detergent, which can be in a loose granular form, or in the form of individual self-contained pods. Any other powders or granular materials, in whatever form, can also be used. Yet other embodiments of the invention can be employed with liquids, dry materials, pastes and gels, for example.

BRIEF DESCRIPTION OF THE DRAWINGS

In order to describe the manner in which at least some aspects of this disclosure can be obtained, a more particular description will be rendered by reference to specific embodiments thereof which are illustrated in the appended drawings. Understanding that these drawings depict only example embodiments of the invention and are not therefore to be considered to be limiting of its scope, embodiments of the invention will be described and explained with additional specificity and detail through the use of the accompanying drawings, in which.

DETAILED DESCRIPTION OF SOME EXAMPLE EMBODIMENTS

Figure 1:
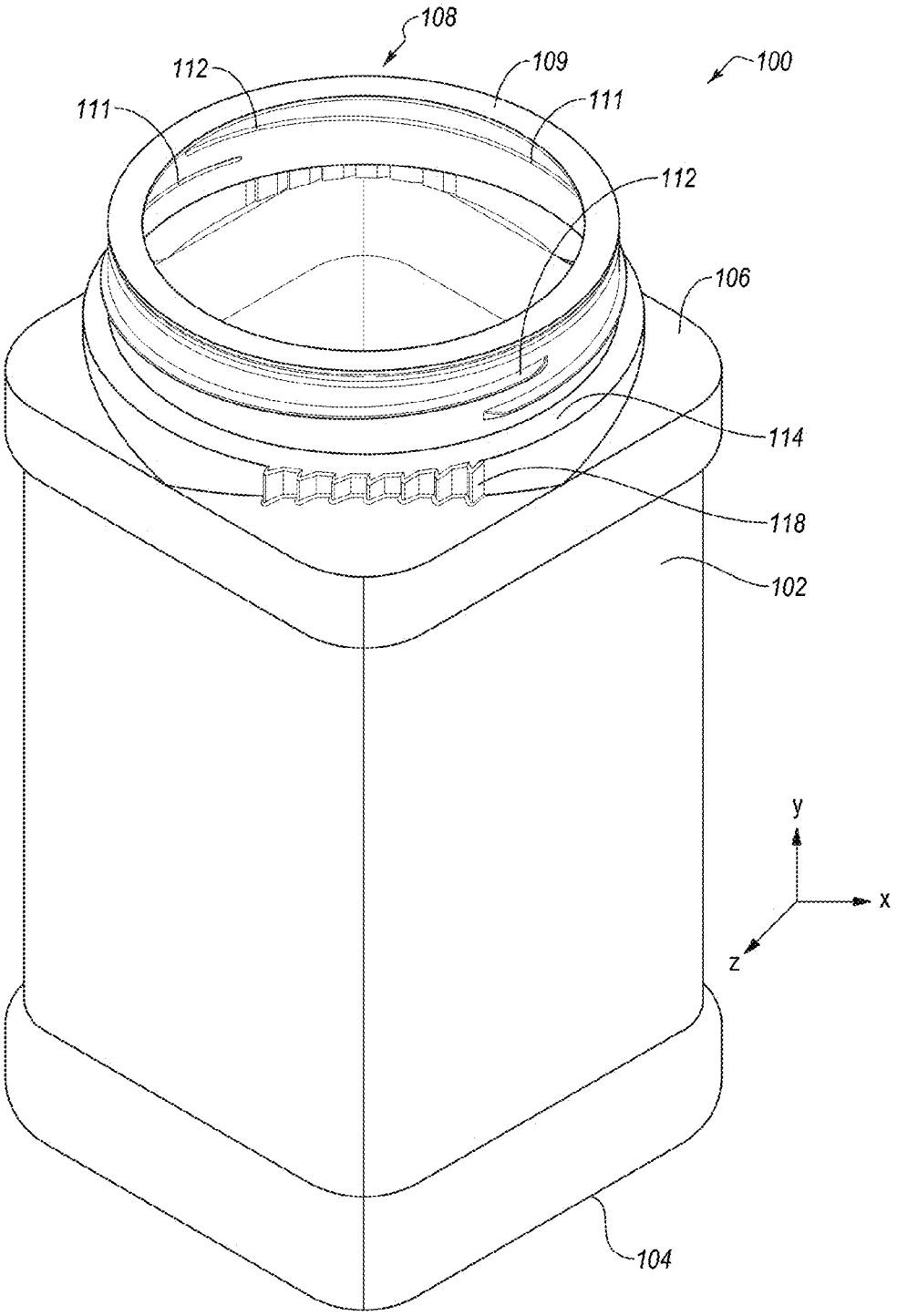
FIG. 1 is a top perspective view of an example container.
Figure 2:
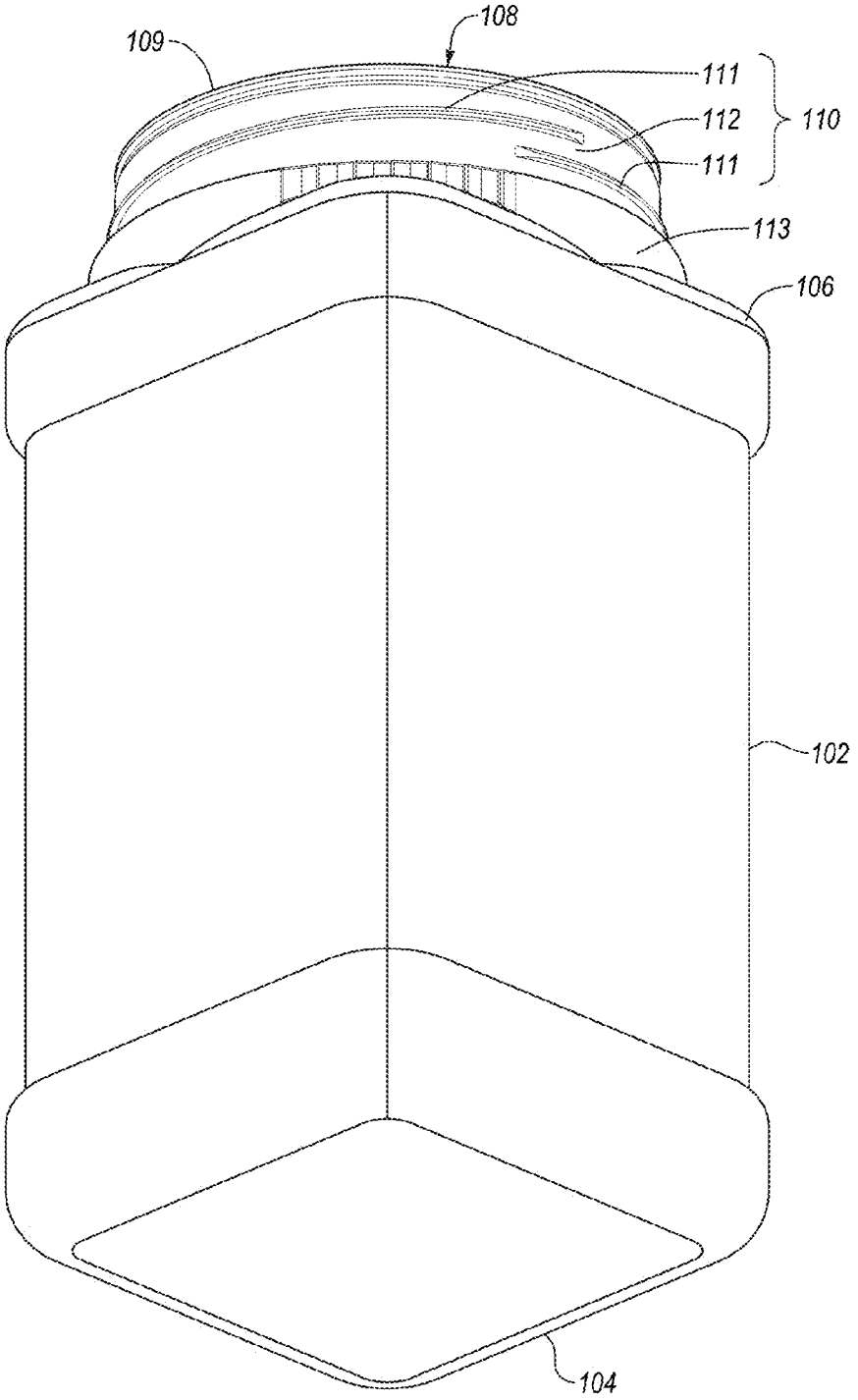
FIG. 2 is a bottom perspective view of an example container.
Figure 3:
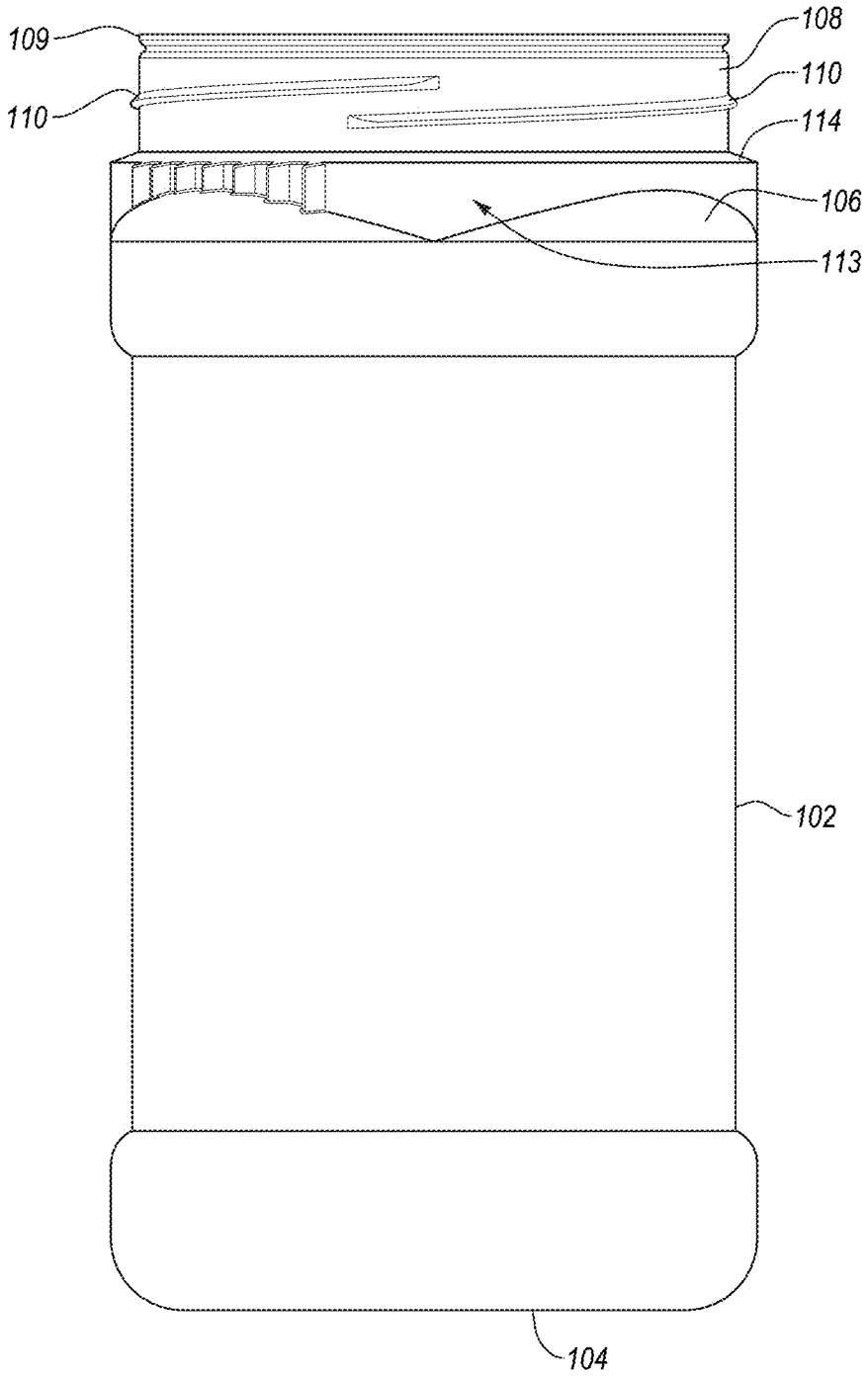
FIG. 3 is a side view of an example container.

Reference will now be made in detail to aspects of various embodiments of the present disclosure, examples of which are illustrated in the accompanying drawings. While described in conjunction with these embodiments, it will be understood that they are not intended to limit the disclosure to these embodiments.

In general, embodiments of the invention can be employed in storing dry materials of various forms such as powders, pods, and granular materials, for example. In other embodiments, the present invention can store liquid materials, gel materials or paste materials as well. Some particular example embodiments of the invention can be used for the storage of laundry detergent or detergent pods, although the scope of the invention is not limited to any particular application or stored material. Thus, further examples of such materials include, but are not limited to, de-icing salts, lawn and garden chemicals such as fertilizers, and any other dry materials that can be contained by one of the disclosed embodiments. Still other particular examples of materials with which various disclosed embodiments can be employed include, but are not limited to, food, gels and paste, beverages, supplements of various types including vitamins and dietary supplements, toys (e.g., army men, LEGO® blocks and pieces, blocks, cars, beads), laundry detergent, laundry bleach, cleaning formulas, cleaning gels, dry chemicals, cleaning utensils, personal care items, shampoo & conditioner, outdoor chemicals (e.g., pool chemicals), paint, litter for pet litter boxes, pet supplements and food, pet treats, pet toys, powder mix for food and drinks, beverage powder, candy and chocolates, nuts, toy articles, medical and/or hospital kits, charcoal. Additional examples of liquids with which some embodiments of the invention can be used include, but are not limited to, cleaning agents, cleaning solutions, cleaning compositions, lawn and garden chemicals, antifreeze, window washing chemicals, windshield de-icing liquids, motor oil, and any other liquids that can be contained by one of the disclosed embodiments. Further examples of materials that can be employed in connection with one or more of the disclosed embodiments include vitamins and medicines, whether in liquid or dry form.

More generally, and as the aforementioned examples collectively demonstrate, embodiments of the invention are not limited to use with any particular material(s). Moreover, embodiments of the invention embrace both containers that are empty, as well as containers that are full, or partly full, of any of the materials disclosed herein, and/or any other materials.

A. Example Container

Directing attention now to FIGS. 1-5, and 11, details are provided concerning a container, one example of which is denoted generally at 100. In at least some embodiments, the container 100 comprises, or consists of, plastic, although other materials could alternatively be used. The container 100 can be formed using any suitable method or process, examples of which include injection molding, blow-molding, and vacuum molding. When manufacturing processes such as these are employed, the container 100 can be formed of a single piece of material, although that is not necessarily required.

In general, the example container 100 has four walls 102, a bottom 104, a top 106, and a generally circular mouth 108 that includes mating structure 109, which can take the form of a flange or other configuration, that is configured and arranged to interface with a lid (discussed below). While the illustrated example of the container 100 is relatively taller than it is wide, and has a generally square cross-section in the X-Z plane, any other configuration can be employed. For example, the container 100 can alternatively have fewer than four sides, such as three sides for example, or can have more than four sides, such as five or six sides for example. Alternatively, the container 100 may have a cylindrical form such that a cross-sectional shape of the container 100 in the X-Z plane is generally circular. More generally however, the scope of the invention is not limited to any particular configuration of a container 100.

As well, it should be noted that the scope of the invention is not limited to containers 100 of any particular configuration, size or dimensions. In the illustrated example, the outside diameter of the mouth 108 is about the same size as the length of the walls 102 in the X-Z plane, although larger or smaller mouths 108, relative to the container 100 wall size 108, could be used in other embodiments. In terms of its dimensions, the mouth 108 outside diameter can be any size. In some embodiments, the container 100 may have a mouth 108 outside diameter in a range of about 4 inches to about 24 inches, although smaller or larger mouth 108 outside diameters could be used in other embodiments. Thus, some particular example ranges of mouth 108 outside diameter include, but are not limited to, about 3 inches to about 7 inches, about 12 inches to about 24 inches, about 8 inches to about 16 inches, about 6 inches to about 12 inches, and any other ranges that can be defined within the range of about 4 inches to about 24 inches.

It should be noted that in some embodiments, the mouth 108 outside diameter may be substantially the same as the mouth 108 inside diameter, while in other embodiments, the mouth 108 outside diameter may be substantially larger, possibly by as much as about 1/16 of an inch to about 3/8 of an inch, than the mouth inside diameter. The differential in size between mouth 108 inside diameter and mouth 108 outside diameter may also be considered in terms of the wall 102 thickness of the container 100. That is, differential in size between mouth 108 inside diameter and mouth 108 outside diameter may, in some embodiments, be about the same as the wall 102 thickness of the container 100.

With continued reference to FIGS. 1-5, the mouth 108 of the container 100 may include threads 110. In the illustrated embodiment, the threads 110 are external threads, that is, they are located on the outside of the mouth 108. However, in other embodiments, the threads 110 may be internal threads located on the inside of the mouth 108. Any size, pitch, angle, type or arrangement of threads 110 can be used. In some particular embodiments, the threads 110 include a relatively small number of thread starts 112, for example, four or fewer thread starts. In the illustrated example, the threads 110 include only two thread portions 111, each of which has a corresponding thread start 112 are provided. In general, a thread start 112 refers to the uppermost, relative to the top of the container 100, start of the thread portions 111.

The use of only two thread starts 112 in the illustrated example enables a user to fully attach (see FIG. 11) or remove a lid (see FIGS. 6-10 discussed below) with only about a half turn of the lid. Finally, the two thread starts 112 are arranged about the perimeter of the mouth 108 such that they are about 180 degrees apart from each other. Embodiments with more than two thread starts 112 could be configured so that the thread starts 112 are equally spaced apart from each other about the perimeter of the mouth 108.

Figure 4:
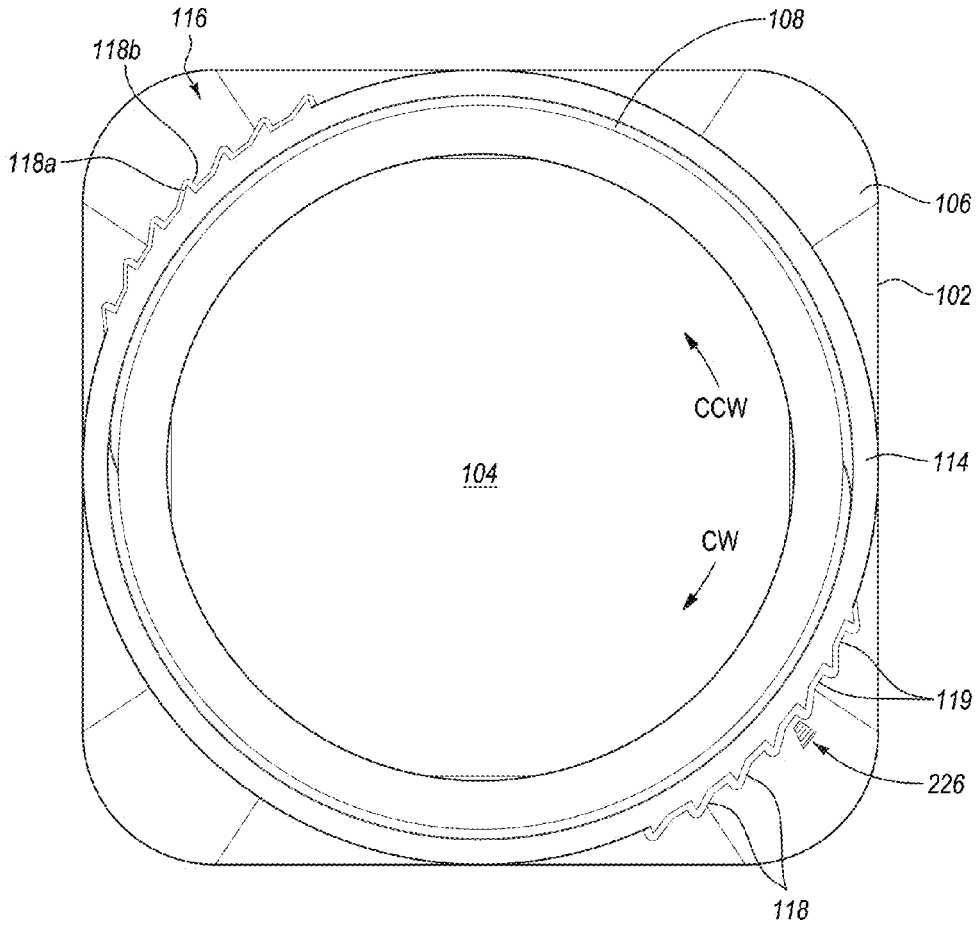
FIG. 4 is a top view of an example container.
Figure 5:
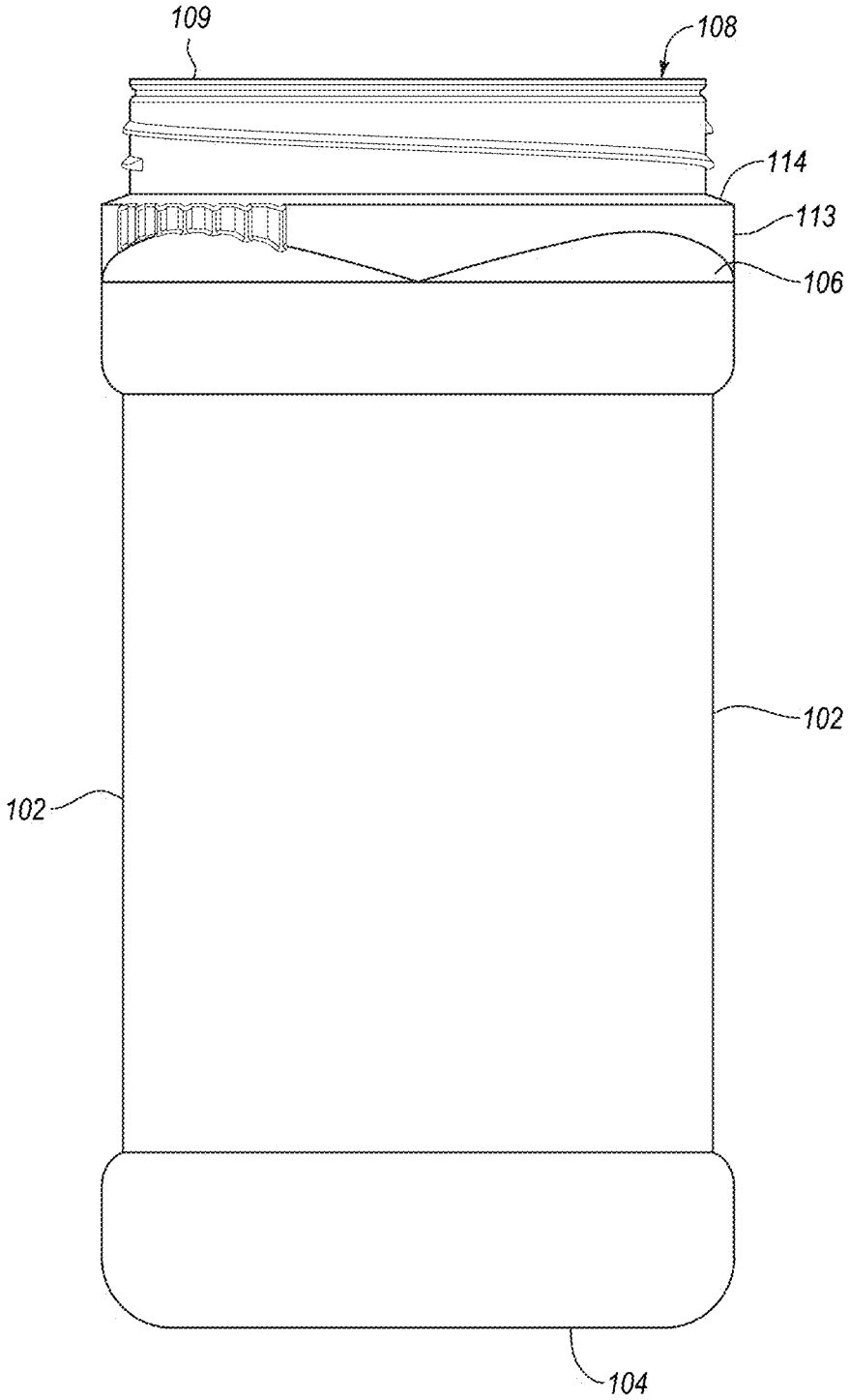
FIG. 5 is a section view of an example container.

With particular reference now to FIG. 4, and continuing reference to FIGS. 1-3 and 5-6, details are provided concerning aspects of the container 100 that enable the use of a locking lid. In particular, the container 100 may include a neck 113 that defines an annular shoulder 114 which is in close proximity to the bottom of a lid (see FIG. 11) when the lid is fully engaged with the container 100. Disposed about the perimeter of the shoulder 114 are one or more sets 116 of engagement elements 118, where the engagement elements 118 may be separated from each other by gaps 119. While the illustrated example of the container 100 includes two sets 116 of engagement elements 118, other embodiments of the container 100 may include more, or fewer, sets 116 of engagement elements 118. The use of two sets 116 enables the user to place the lid (discussed below) anywhere on the container 100 and to secure the lid on the container 100 with, at most, a half turn.

In general, the engagement elements 118 are sized, configured, arranged, and oriented to releasably disengage one or more corresponding engagement elements of a lid so that the lid can be locked onto the container 100. In the illustrated example, the engagement elements 118 are shaped like teeth, such as might be found on a circular saw blade, although any other suitable configuration could be used. The two sets 116 are arranged about the perimeter of the shoulder 114 so that they are about 180 degrees apart from each other. Embodiments with more than two sets 116 could be configured so that the sets are equally spaced apart from each other about the circumference of the shoulder 114. As best shown in FIG. 1, the first engagement element 118 of each of the sets 116 may be located, using the perimeter of the mouth 108 as a reference, proximate one of the thread starts 112.

With continued reference to FIG. 4, each of the engagement elements 118 includes a ramp portion 118*a* and a drop portion 118*b*, and the engagement elements 118 are arranged so that the drop portions 118*b* face in a clockwise direction when the container 100 is viewed from the top. In the illustrated example, each set 116 includes seven engagement elements 118, although more or fewer engagement elements 118 can be used in each set 116. In general, and as explained more fully in the discussion of FIGS. 6-10, the ramp 118*a* configuration of the engagement elements 118 enables a corresponding engagement element of a lid to move, in a clockwise direction, past the engagement elements 118 as the lid is secured to the container 100. On the other hand, the drop 118*b* configuration of the engagement elements helps to prevent rotation of the lid in a counterclockwise direction when it is desired that the lid remain locked to the container 100. In this regard, it should be noted that the engagement elements 118 are one example of a structural implementation of a means for releasably engaging a lid. Thus, any other engagement element configuration that provides the aforementioned functionality in the clockwise and counterclockwise directions can alternatively be used.

B. Example Lid

With reference now to FIGS. 6-11, details are provided concerning a lid that can be used in conjunction with a container such as container 100. One example of a lid is denoted in the Figures generally at 200. In at least some embodiments, the lid 200 comprises, or consists of, plastic, although other materials could alternatively be used. The lid 200 can be formed using any suitable method or process, examples of which include injection molding, blow-molding, and vacuum molding. When manufacturing processes such as these are employed, the lid 200 can be formed of a single piece of material, although that is not necessarily required.

As indicated, the lid 200 is generally circular in shape, although other shapes and configurations, such as any polygon for example, could alternatively be used. Where the lid 200 is circular, it may have an inside diameter that is consistent with any of the example outside diameters of the mouth 108 noted earlier. The lid 200 can also be considered in terms of the size of its outside diameter. As such, example embodiments of the lid 200 can have an outside diameter in a range of about 4 inches to about 24 inches, although smaller or larger lid 200 outside diameters could be used in other embodiments. Thus, some particular example ranges of lid 200 outside diameter include, but are not limited to, about 3 inches to about 7 inches, about 4 inches to about 6 inches, about 12 inches to about 24 inches, about 8 inches to about 16 inches, about 6 inches to about 12 inches, and any other ranges that can be defined within the range of about 4 inches to about 24 inches.

The lid 200 includes a top surface 201 with a grip element in the form of a recess 202 that is sized and configured to receive one or more finger portions, such as fingertips, of a user. The size, shape, configuration, depth and orientation of the recess 202 can vary from one embodiment to another. The shape and size of the recess 202 are defined by one or more walls 204, and the depth of the recess 202 is defined by a floor 206. One or more of the walls 204 can be generally vertical, although that is not required and in some cases, one or more of the walls 204 are non-vertical.

In the illustrated example, the recess 202 is generally in the shape of a semicircle, although the recess 202 can be configured to describe an arc length greater than, or less than, about 180 degrees. More generally however, the recess 202 need not have any particular shape. As well, at least one wall 204 of the recess 202 can include a set of indentations that comprises, or consists of, one, two, three, four, or more, indentations 208, each of which is configured to receive a portion of a finger of a user. For example, in one embodiment, the recess 202 has no more, or less, than 4 indentations and three ridges 210. In other embodiments however, no indentations are provided. The ridges 210 between the indentations 208 may help to prevent the fingers of the user from slipping while the lid 200 is being attached to, or removed from, the container 100. The ridges 210 can be omitted in some embodiments. The ridges 210 and indentations 208, or equivalent if the ridges 210 and/or indentations 208 are omitted, may be collectively referred to herein as a grip portion of the grip element, or recess 202 in this example. As shown, one, some, or all of the edges 212 of the recess 202 can be radiused to enhance user comfort. In general, an edge 212 refers to any line or location where two surfaces meet.

As will be apparent from the disclosure herein concerning embodiments of a grip element, such as the recess 202, that grip element can take a variety of different configurations. Thus, the functionality associated with the recess 202, and other grip element embodiments disclosed herein, can be achieved with any of a wide variety of different physical configurations, and the particular grip element configurations disclosed herein are provided only by way of example.

Consistent with the foregoing, and directing attention briefly to FIGS. 6*a*-6*d*, some examples of alternative grip element configurations are disclosed. As indicated there, a first alternative configuration of a grip element takes the form of a recess 203*a* that has only two indentations 205*a*, while a second alternative configuration, in the form of a recess 203*b*, has only a single indentation 205*b*. In another alternative configuration, in the form of a recess 203*c*, no indentations are present. In a final example alternative configuration, in the form of a recess 203*d*, four indentations 205*d* are provided that are isolated from each other, rather than communicating with each other as in the case of the indentations 208 of the recess 202. With reference to this final example, various alternatives of the recess 203*d* may include only the two middle indentations 205*d*, or only the two outermost indentations 205*d*.

Figure 6:
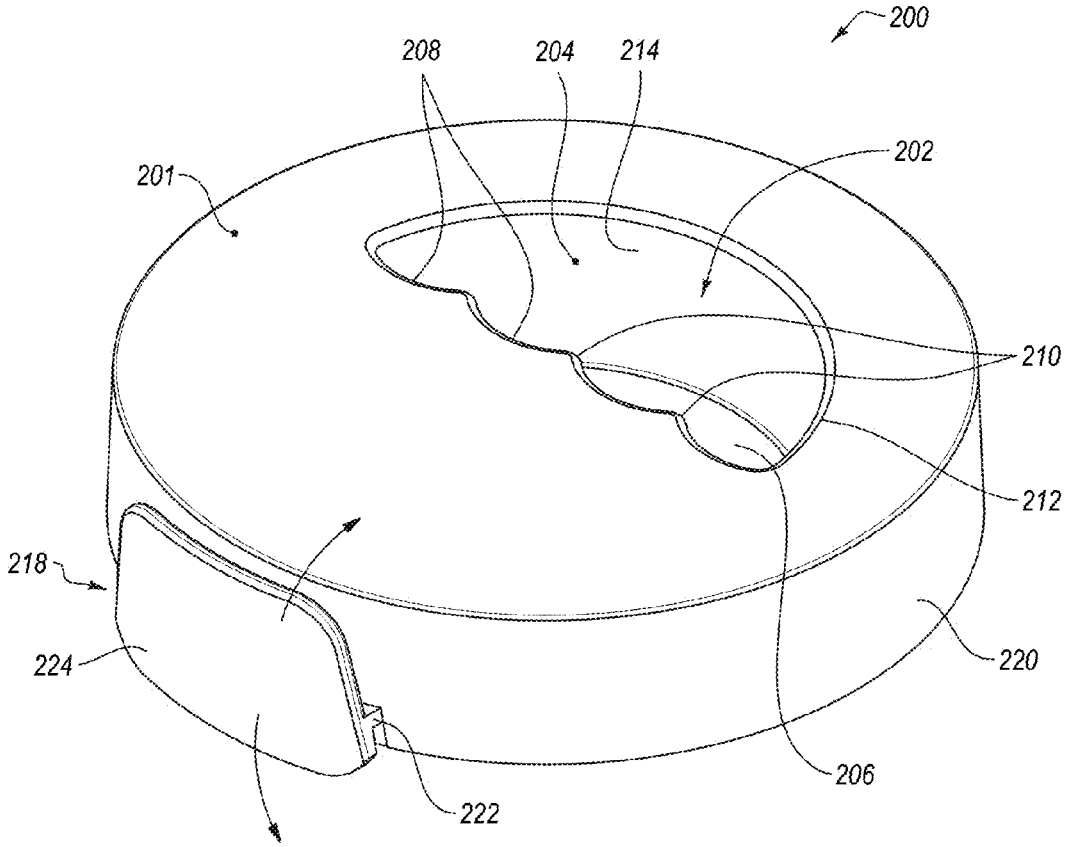
FIG. 6 is a top perspective view of an example lid.
Figure 6A:
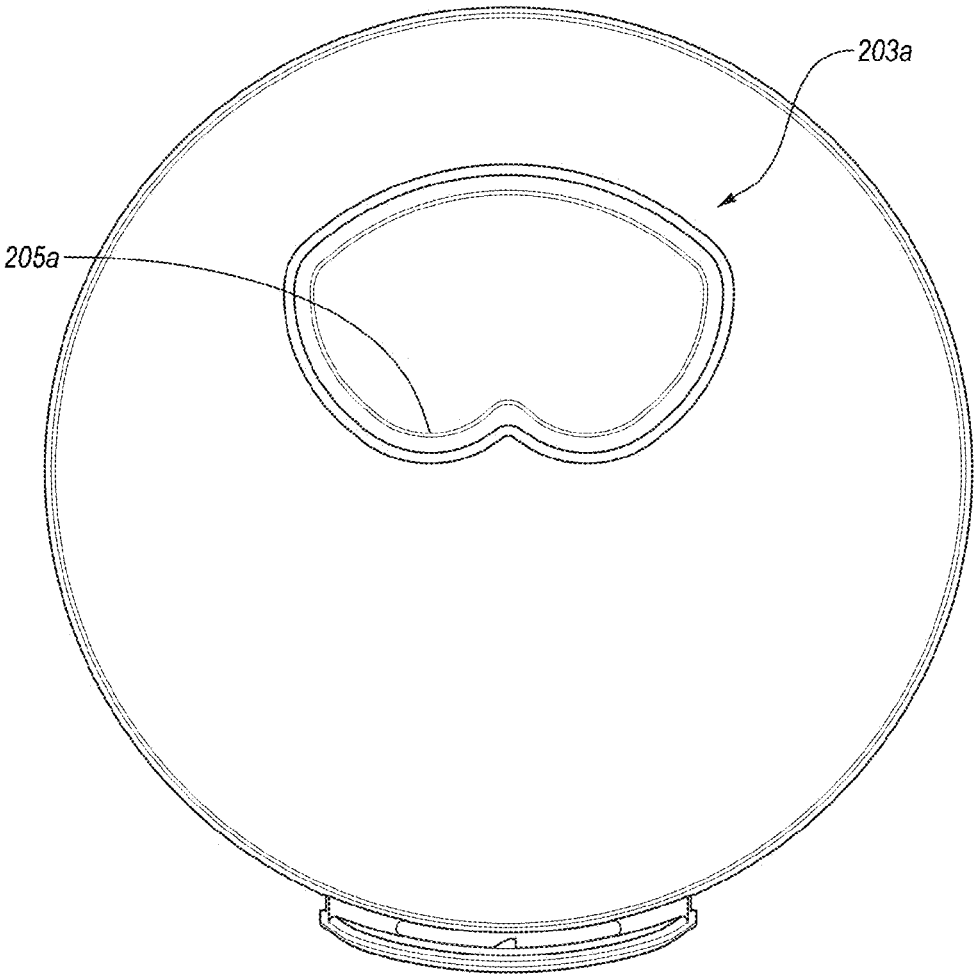
FIGS. 6*a*-6*d* disclose various alternative configurations of a lid with a recess.
Figure 6B:
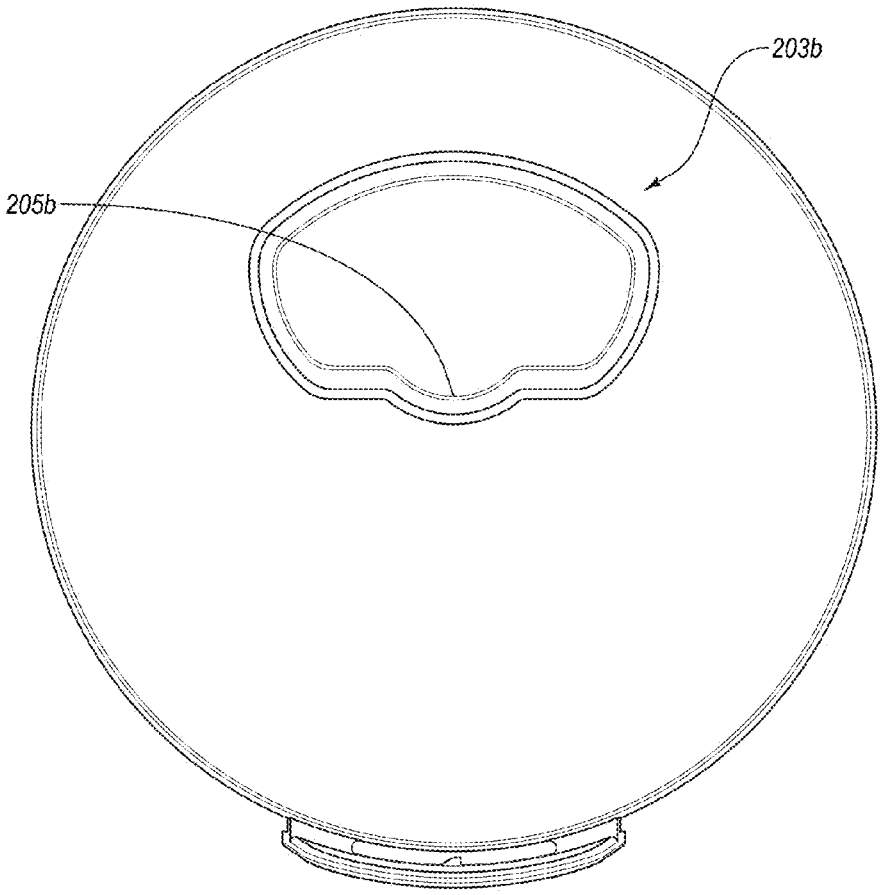
Figure 6C:
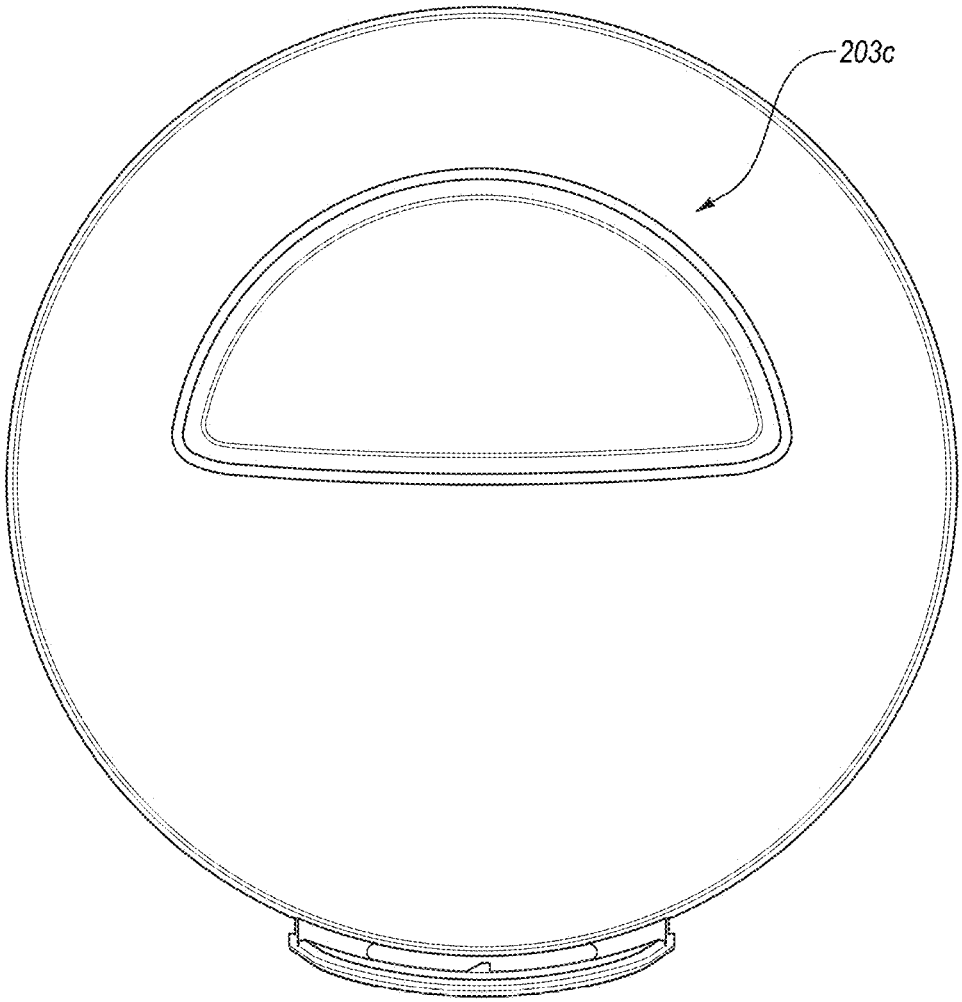
Figure 6D:
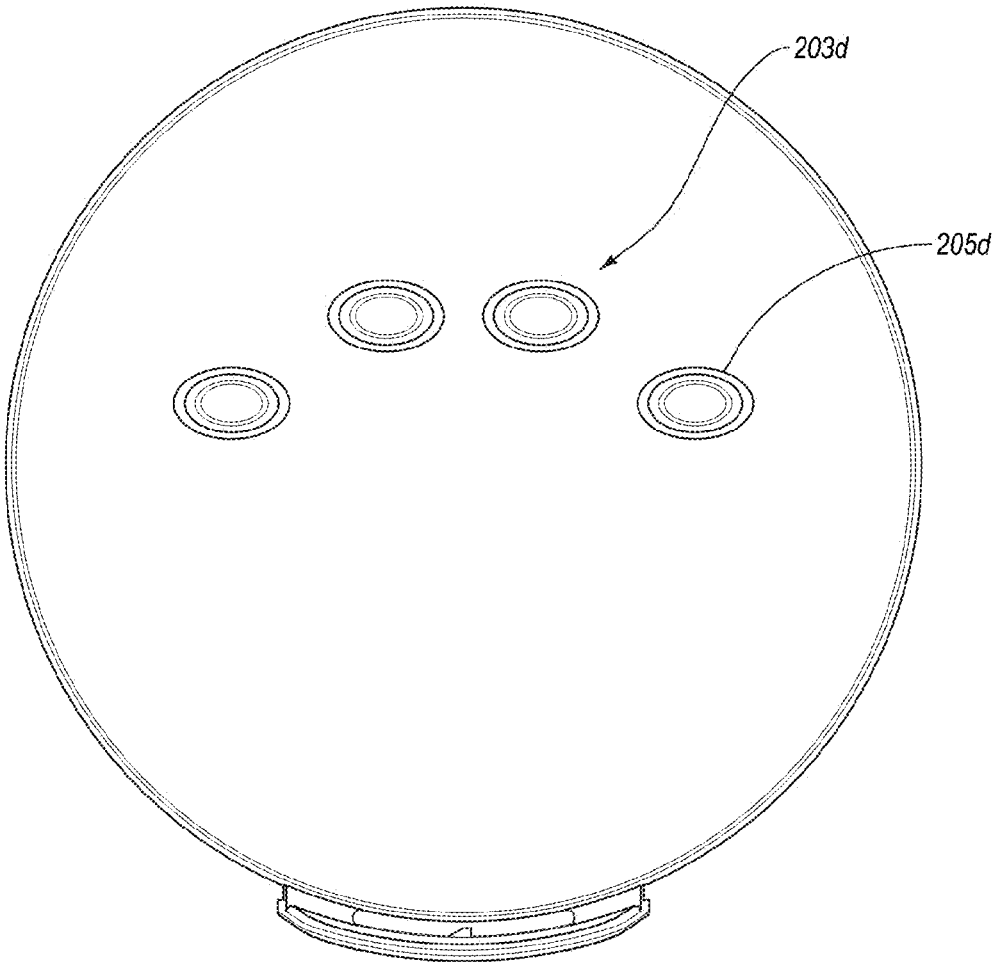
Figure 7:
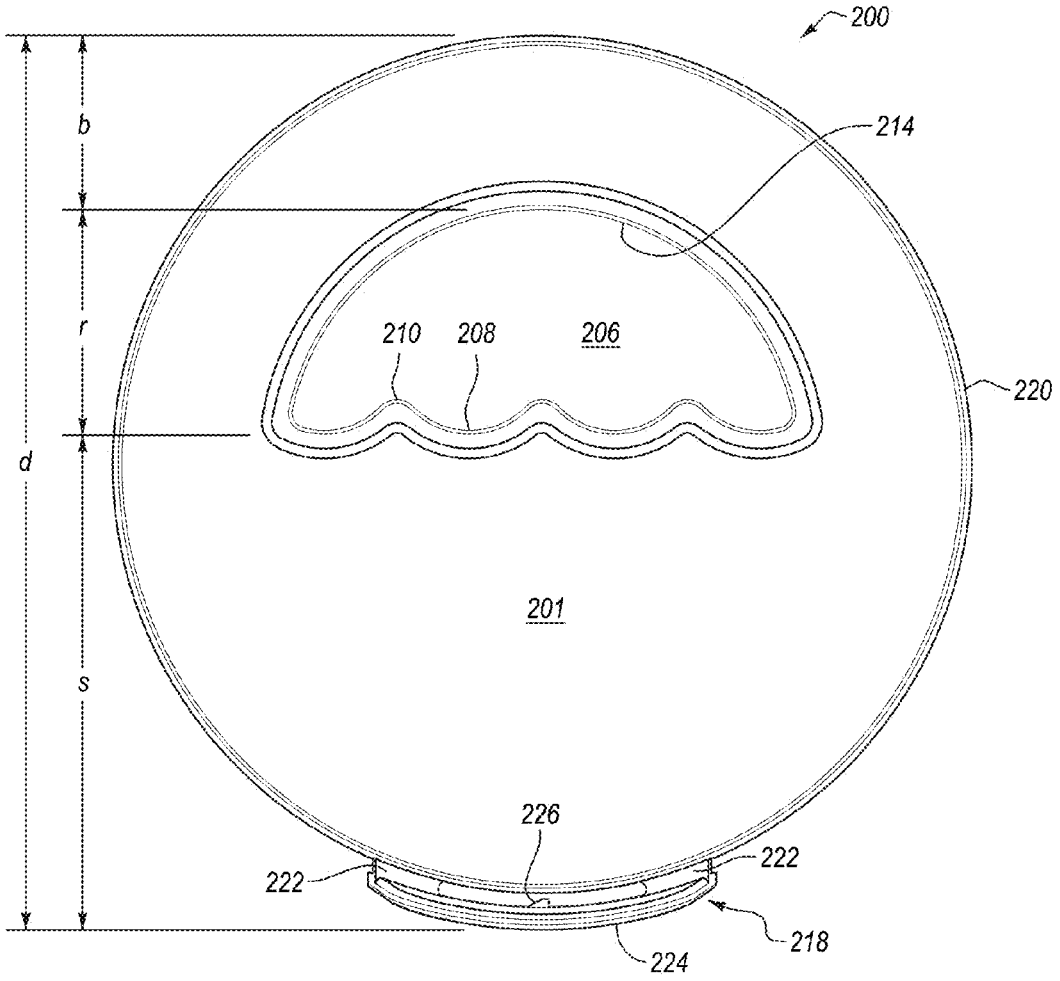
FIG. 7 is a top view of an example lid
Figure 10:
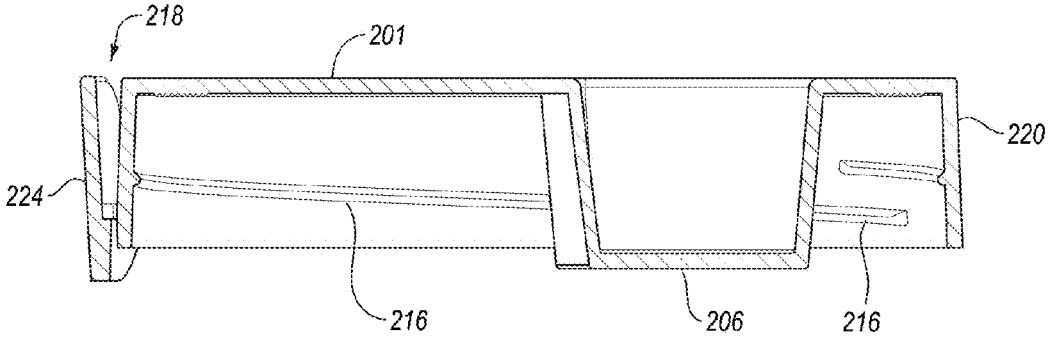
FIG. 10 is a section view of an example lid.

With continued reference particularly to FIGS. 6, 7 and 10, it can be seen that because the outermost wall 214 of the recess 202 is located at a backset distance "b" away from the edge of the lid 200, the placement of the recess 202 effectively reduces the distance that the hand of a user must span when operating the lid 200. In particular, and absent the recess 202, the hand of the user would have to span the entire diameter "d" of the lid 200 in order for the user to attach or remove the lid 200 from the container 100. Thus, the recess 202 serves to reduce the span distance from the lid 200 diameter "d" to a distance of about "s" as shown in FIG. 7. Accordingly, the presence of the recess 202 can make the lid 200 relatively easy to operate, even for users with relatively small hands, limited hand strength, arthritis, or other conditions. Thus, the lid 200 can be made quite large in diameter, but will still be readily operable due to the presence of the recess 202. Accordingly, it will be appreciated that a grip element, such as recess 202 for example, is an example structural implementation of a means for reducing an operating diameter of a lid, where the operating diameter refers to the distance across the lid that must be spanned by the hand of a user in order to operate the lid. Any other structure(s) of comparable functionality to the grip element can alternatively be employed.

It will be appreciated that a variety of physical characteristics such as aspect ratios can be defined that may be employed in designing and producing lids of various sizes and configurations. By way of illustration, various embodiments of the lid 200 can have dimensions that generally correspond to one, some, or all, of the following example ratios, wherein for the indicated ratios, "s" is the span distance, "b" is the backset distance, "d" is the overall diameter of the lid, and "r" is the distance—measured along a diameter of the lid—between the outermost and innermost walls of the recess: s/d=about 0.4 to about 0.6; r/d=about 0.2 to about 0.3; b/d=about 0.1 to about 0.3. It should be apparent that still other ratio values can be derived from the foregoing examples, and such other ratios are considered to be embraced within the scope of this disclosure. It should be noted that some lid 200 configurations do not conform to any of the specific example aforementioned ratio values or ranges of ratio values. That is, other embodiments of the lid can reflect ratio values that are larger, or smaller, than the particular ranges of ratio values noted above. Accordingly, the scope of the invention is not limited, nor should be construed to be limited, to any particular ratio or range of ratios.

Figure 8:
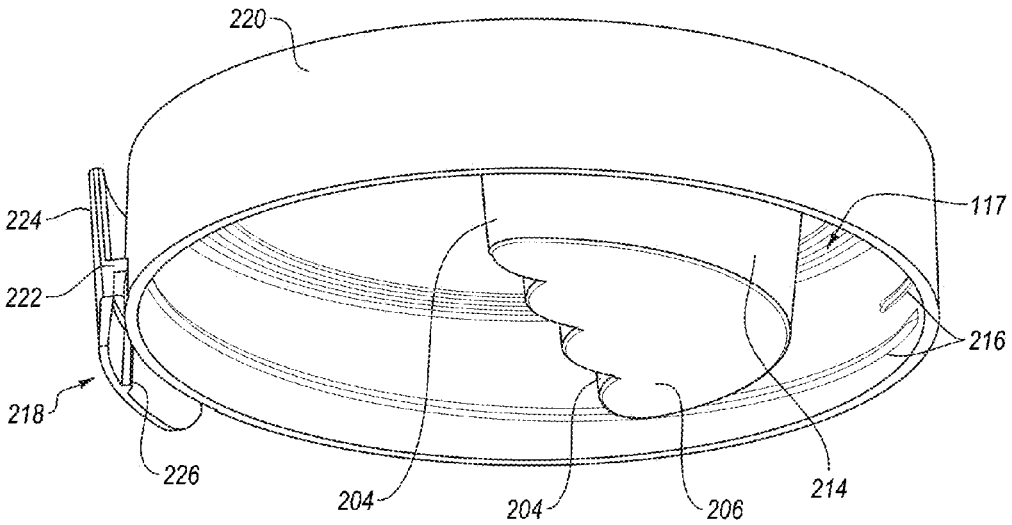
FIG. 8 is a bottom perspective view of an example lid.

Directing attention now to FIGS. 6-8 in particular, further details are provided concerning the example lid 200. In particular, and as best shown in FIG. 8, the interior of the lid 200 may include threads 216 that are generally configured and arranged to interface with the threads 110 of the container 100. It will be apparent that the threads 216 can be similar, or identical, to the threads 110. As also indicated in FIG. 8, the lid 200 can include a plurality of ridges 117, which may or may not be concentric. Among other things, the ridges 117 can help to improve contact between the lid 200 and the container 100, thus improving the seal between the two elements. The ridges 117 may be particularly beneficial where the surface of the mating structure, such as a flange, of the container 100 is irregular in its configuration and/or finish. The ridges 117 may also enable a reduction in the thickness of the plastic in the lid 200, and the sinks in the associated molds. Where a particular container and lid are intended for use with a liquid, a gasket, O-ring, and/or other sealing element(s) can be provided between the lid and container to implement a fluid-tight seal which can ensure that the escape of liquid from the container is prevented.

The lid 200 further includes a tab 218 that is attached to a side wall 220 of the lid 200. The height of the tab 218 is such that the bottom edge of the tab 218 is positioned below the lower edge of the side wall 220 of the lid 200 so that, as discussed below, the lid 200 can be locked onto the container 100. While the example tab 218 is generally in the shape of a parallelogram whose top side is longer than its bottom side, the tab can take any other shape consistent with its functionality. Thus, other embodiments of the tab could be round, oval, elliptical, square, or rectangular, to name a few examples.

As best shown in FIGS. 6 and 7, this attachment can be effected by one or more standoff elements 222. The standoff elements 222 are elastically deformable and thus are able to collectively serve as a pivot axis about which the tab 218 can rotate. In more detail, and with particular reference to FIG. 6, the tab 218 is able to rotate back and forth in the directions indicated by the arrows. As discussed in more detail below, movement of the tab 218 can be effected by the hand, specifically the palm, of a user.

In some embodiments, a distance "s" between the grip portion of the recess 202 and an outer surface of the tab 218 is in a range of about ¼ of a diameter "d" of the lid 200 to about ¾ of the diameter "d" of the lid 200. In still other embodiments, a distance "s" between the grip portion of the recess 202 and an outer surface of the tab 218 is in a range of about ⅜ of a diameter "d" of the lid 200 to about ⅝ of the diameter "d" of the lid 200. Examples of associated aspect ratios involving a span distance "s" are disclosed elsewhere herein. It should be noted that some lid 200 configurations do not conform to any of the specific example aforementioned aspect ratio values or ranges of aspect ratio values. That is, other embodiments of the lid can reflect aspect ratio values that are larger, or smaller, than the particular ranges of aspect ratio values noted above. Accordingly, the scope of the invention is not limited, nor should be construed to be limited, to any particular aspect ratio or range of aspect ratios.

The pivot axis defined by the standoff element(s) 222 can be positioned at any desired vertical location on the tab 218. In the example of FIG. 6, the pivot axis defined by the standoff elements 222 is relatively closer to the bottom edge of the tab 218 than to the top edge of the tab 218. In other embodiments, the pivot axis defined by the standoff elements 222 is relatively closer to the top edge of the tab 218 than to the bottom edge of the tab 218, while in still other embodiments, the pivot axis defined by the standoff elements 222 may be about midway between the bottom edge of the tab 218 and the top edge of the tab 218.

In general, the normal, or undeflected, position of the tab 218 can be as shown in FIGS. 6-9. As indicated, the actuation surface 224 of the tab 218 may be generally parallel to the side wall 220 of the lid when the tab 218 is in the normal position. The actuation surface 224 and the side wall 220 may be substantially vertical, or may be non-vertical in their orientation. When the tab 218 is squeezed by a user performing an operation such as unlocking the lid 200 from the container 100, the top edge of the tab 218 can rotate toward the side wall 220 of the lid 200, as shown in FIG. 6. When released by the user, and as shown in FIG. 6, the top edge of the tab 218 rotates away from the side wall 220 under the biasing influence of the deformable standoff elements 222 and returns to the normal, undeflected, position.

Figure 9:
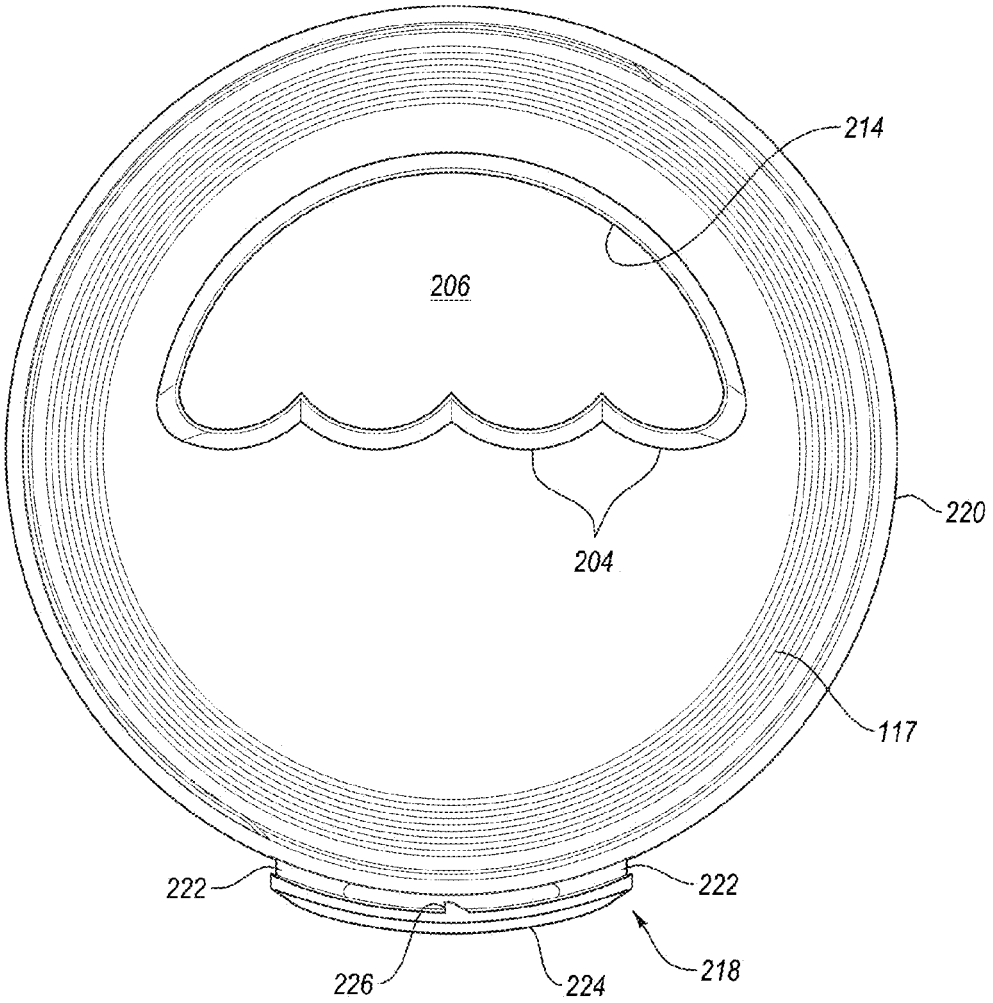
FIG. 9 is a bottom view of an example lid.
Figure 11:
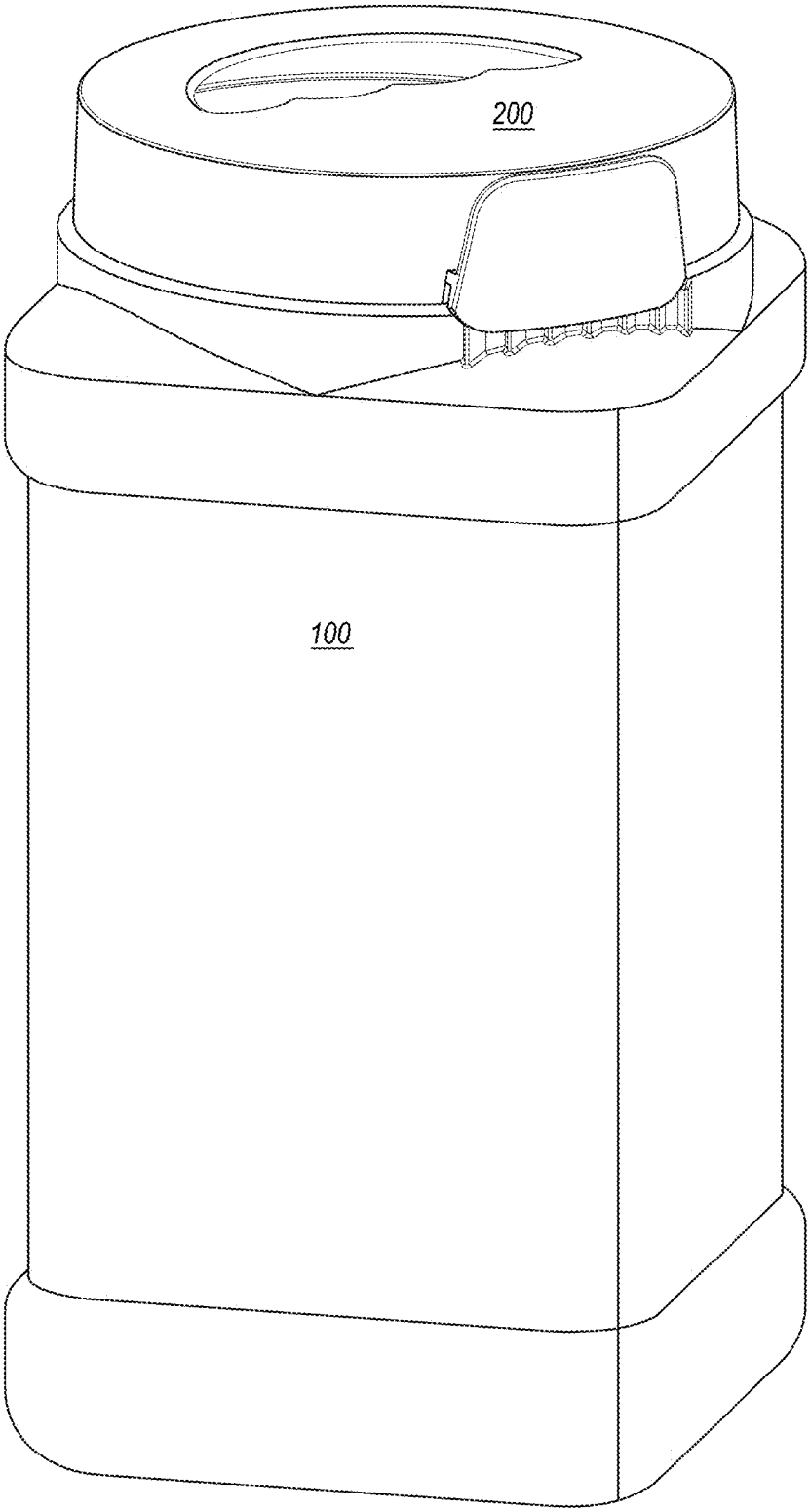
FIG. 11 is a side view showing a lid positioned on a container.

With particular reference now to FIGS. 7-9, further details are provided concerning the example lid 200. Specifically, the tab 218 of the lid 200 may include one or more engagement elements 226. In the specific example of FIG. 8, only a single engagement element 226 is provided, and the engagement element 226 has a cross-section shaped as shown in FIG. 4, although any other suitable shapes could be used. In general, because the engagement element 226 is positioned at the lower edge of the tab 218, the engagement element 226 can be removably positioned in a gap 119 (see FIG. 4) between the engagement elements 118 on the neck of the container 100 when the lid 200 is positioned on the container 100, as best shown in FIG. 11.

As further collectively indicated in FIGS. 4 and 11, both the engagement elements 118 and the engagement element 226 are positioned below the lowermost edge of the lid 200. Thus, a locking mechanism, comprising, or consisting of, the tab 218, the engagement elements 118, and the engagement element 226 is external to the lid 200.

C. Operation of a Lid and Container

With continued reference to the Figures, when the lid 200 is placed on the container 100 and rotated clockwise, the threads 110 and 216 engage each other and the lid 200 moves into a closed position or state. As the lid 200 rotates toward the closed position, the engagement element 226 moves along the engagement elements 118 in a clockwise direction (see FIG. 4). During this operation, the tab 218 may not be in a deflected state, with the result that an interference exists between the engagement element 226 and the engagement elements 118. This interference is overcome however since the standoff elements 222 are elastically deformable and will thus allow the tab 218 to deflect somewhat as the lid 200 is rotated, even if the tab 218 is not being grasped by the user.

The movement of the engagement element 226 past the engagement elements 118 during a clockwise rotation of the lid 200 is further facilitated by the ramp portions 118*a*. In particular, as the lid 200 rotates to the closed position, the engagement element 226 can slide upward, that is, clockwise (see FIG. 4), relatively easily along the inclined surface of the ramp portions 118*a* so that the tab 218 deflects slightly as the lid 200 is rotated clockwise. When the lid 200 has been fully rotated clockwise to the closed position (see FIG. 11), the engagement element 226 comes to rest in one of the gaps 119 (FIG. 4). Movement of the lid 200 in the opposite, counterclockwise direction, is prevented by one of the drop portions 118*b*, since the engagement element 226 is not able to easily move past the drop portion 118*b*, as indicated at FIG. 4.

In order to unlock and remove the lid 200 from the container 100, the user can insert one or more of his fingers in the recess 202 and then squeeze the tab 218 with his palm so that the upper edge of the tab 218 rotates toward the side wall 220 of the lid 200, as shown in FIG. 6. Because the engagement element 226 is attached to the tab 218, this movement of the tab 218 causes the engagement element 226 to move out of the gap 119 so that there is no longer an interference between the engagement elements 118 and 226. Once the engagement element 226 of the lid 200 has cleared the engagement elements 118 of the container 100 in this way, the lid 200 can be turned in the counterclockwise direction and removed from the container. Because some embodiments provide for only two thread starts, the lid 200 may be able to be removed with only a half turn, or 180 degree turn. As well, the user can unlock and remove the lid 200 from the container 100 without having to use his thumb. Instead, and as explained herein, embodiments of the invention are configured so that the user can grasp and hold the lid 200 with only his palm and one or more fingertips.

D. Example Alternative Embodiments

Figure 12A:
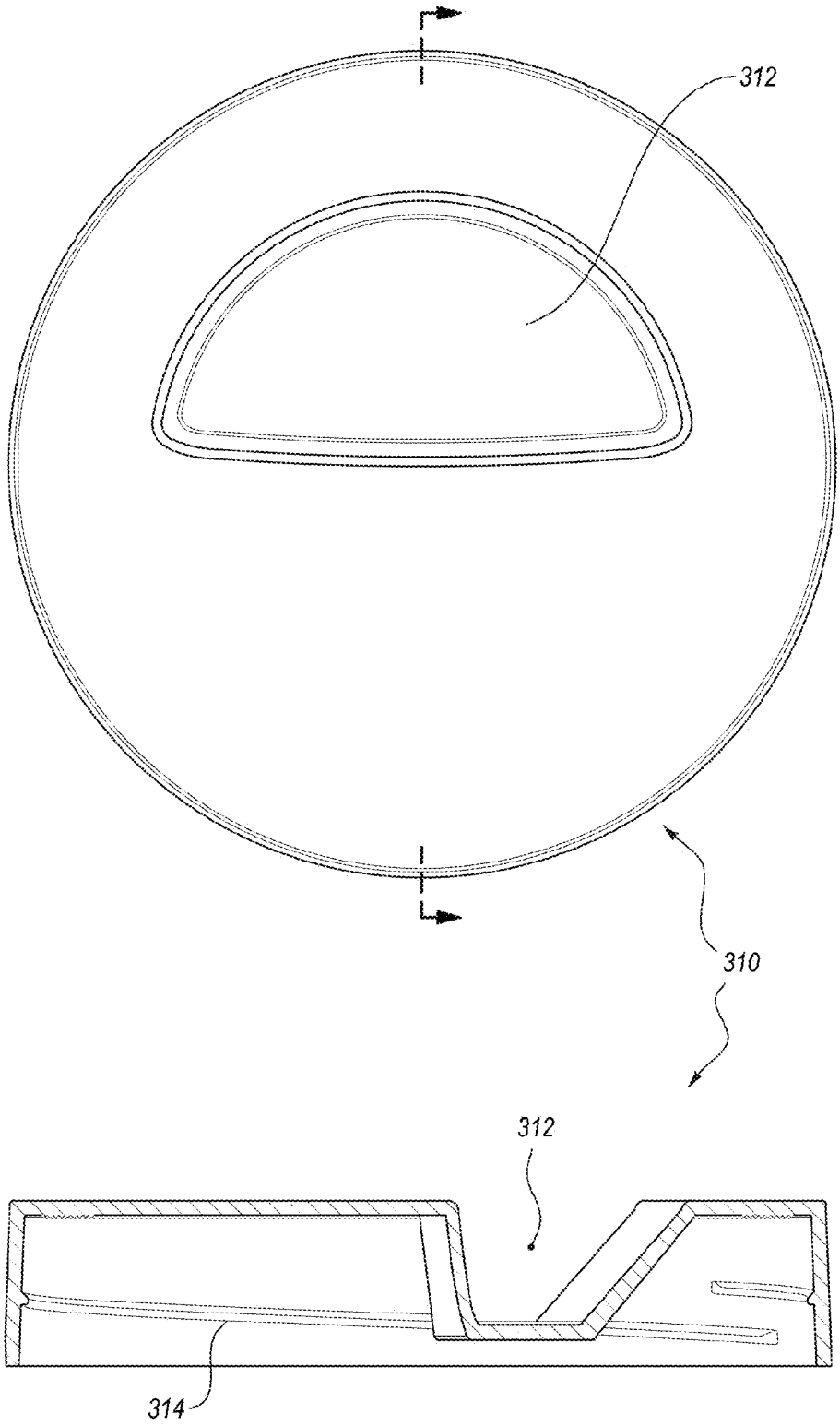
FIGS. 12*a*-12*c* are directed to further embodiments of a non-locking lid.

With attention now to FIGS. 12*a*-15*d*, details are provided concerning some example alternative embodiments. With particular regard first to FIG. 12*a*, it was noted earlier that some embodiments of the invention provide for a non-locking lid. Thus, such embodiments may omit, for example a tab and engagement elements, while still including one or more grip elements, some examples of which are disclosed elsewhere herein. At least some of those grip elements include one or more recesses formed in an upper surface of a lid. As indicated in FIG. 12*a*, for example, yet other grip elements may take a form other than a recess, and still other example grip elements may include one or more recesses along with one or more other portions, such as raised portions for example.

For example, and as shown in FIG. 12*a*, a non-locking lid 310 is disclosed that includes a grip element 312 in the form of a recess. The non-locking lid 310 also includes threads 314 configured to releasably engage corresponding threads of a container (not shown). As suggested by its name, the non-locking lid 310 omits a tab, engagement elements, and other structures that would enable the non-locking lid 310 to be locked onto a container. Thus, the non-locking lid 310, and other embodiments of non-locking lids disclosed herein, may be used in applications where, for example, the material (s) held by a corresponding container would not present any significant harm if those materials were released from the container in an uncontrolled manner.

Figure 12B:
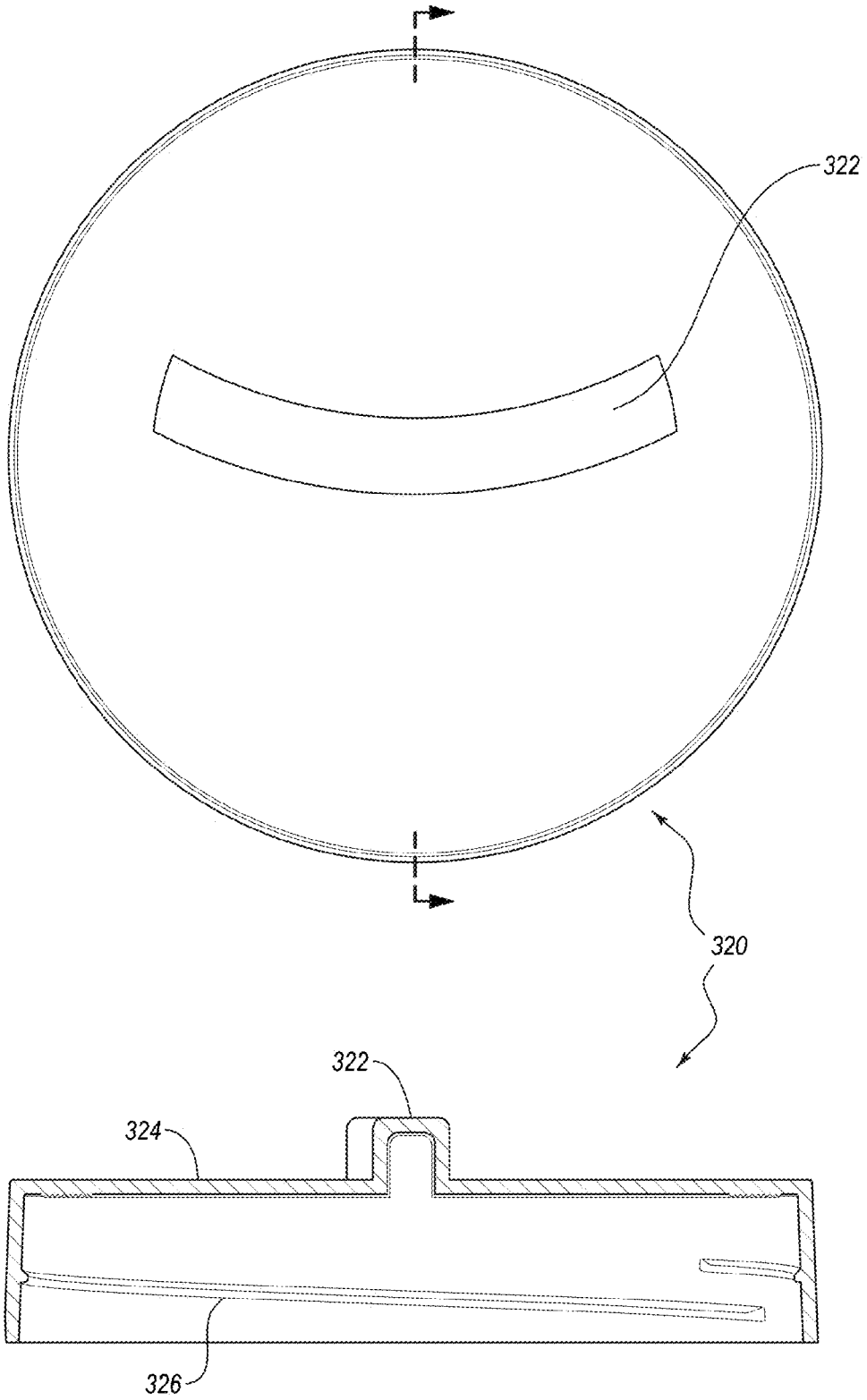

With reference to FIG. 12*b*, another embodiment of a non-locking lid is denoted generally at 320. The non-locking lid 320 can include a grip element 322, or multiple grip elements 322, in the form of a raised portion, that is, a portion that extends above the upper surface 324 of the non-locking lid 320. As shown in the top view of this embodiment, the grip element 322 can have a curved shape that may enable a user to grasp and retain the grip element 322 while operating the non-locking lid 320.

The non-locking lid 320 also includes threads 326 configured to releasably engage corresponding threads of a container (not shown). As suggested by its name, the non-locking lid 320 omits a tab, engagement elements, and other structures that would enable the non-locking lid 320 to be locked onto a container.

A useful aspect of embodiments such as the non-locking lid 320 whose grip element(s) do not include any recesses is that such lids can be employed in connection with containers (not shown) that may include a protective film or similar element across the top of the container. That is, the lack of any recesses that protrude downward into the interior of the container enables the upper flange, for example, of the container to abut the underside of the non-locking lid 320 without any danger of the protective film being punctured or otherwise compromised by a protrusion extending downwardly from the inside of the non-locking lid 320.

Figure 12C:
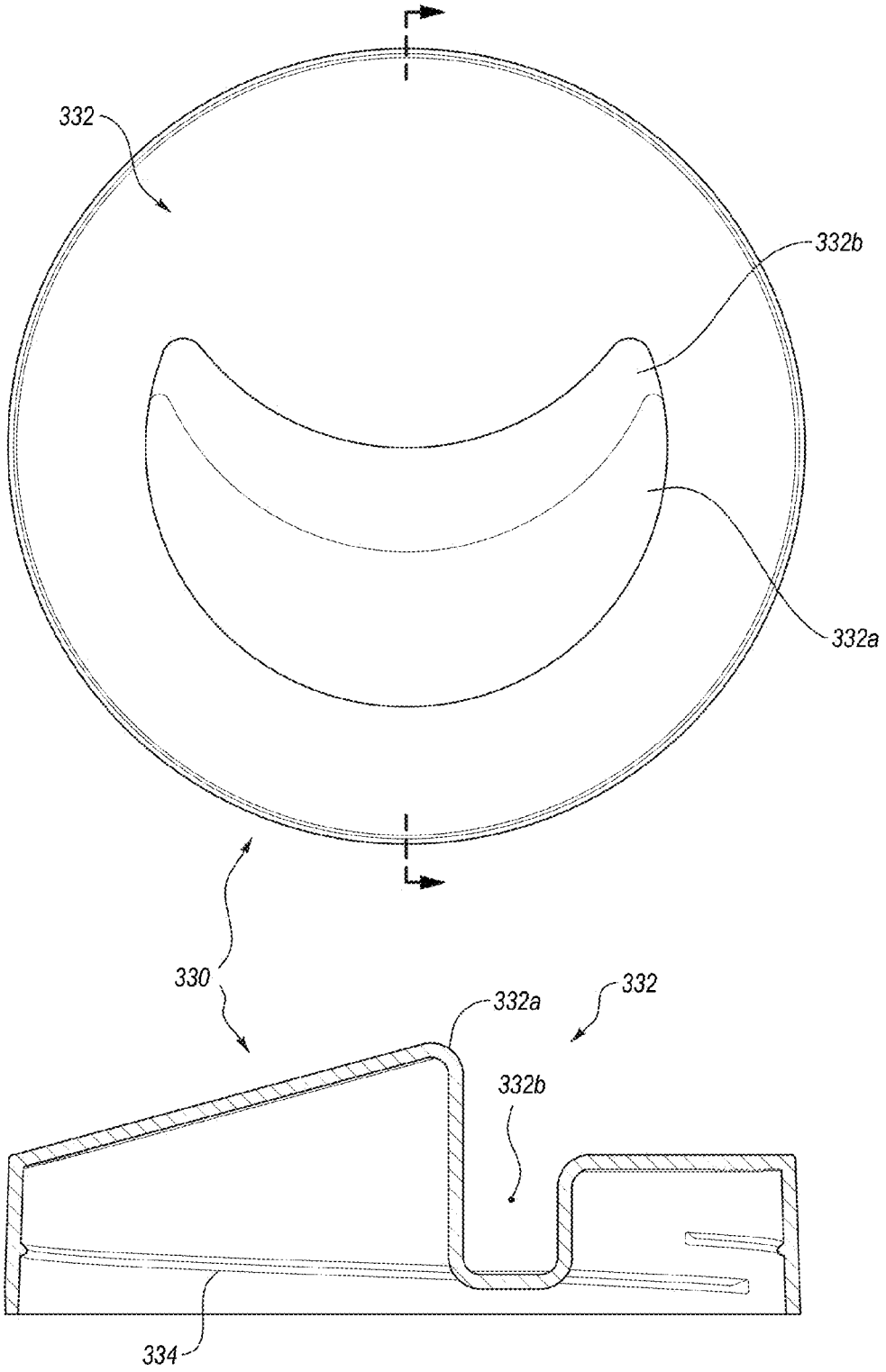

Another embodiment of a non-locking lid is denoted generally at 330 in FIG. 12*c*. In this example embodiment, the non-locking lid 330 includes aspects of both the non-locking lid 310 and the non-locking lid 320. In particular, the non-locking lid 330 includes a grip element 332 with both a raised portion 332*a* and a recess 332*b*. The non-locking lid 330 also includes threads 334 configured to releasably engage corresponding threads of a container (not shown). As suggested by its name, the non-locking lid 330 omits a tab, engagement elements, and other structures that would enable the non-locking lid 330 to be locked onto a container.

With continued reference to FIGS. 12*a*-12*c*, the example non-locking lids 310, 320 and 330 can employ a variety of different thread configurations. By way of illustration, any or all of these non-locking lids can employ a single thread start, two thread starts, three thread starts, or four thread starts. Other embodiments can employ more than four thread starts. In general, where multiple thread starts are employed, those thread starts can be equally angularly spaced around the circumference of the lid.

Figure 13A:
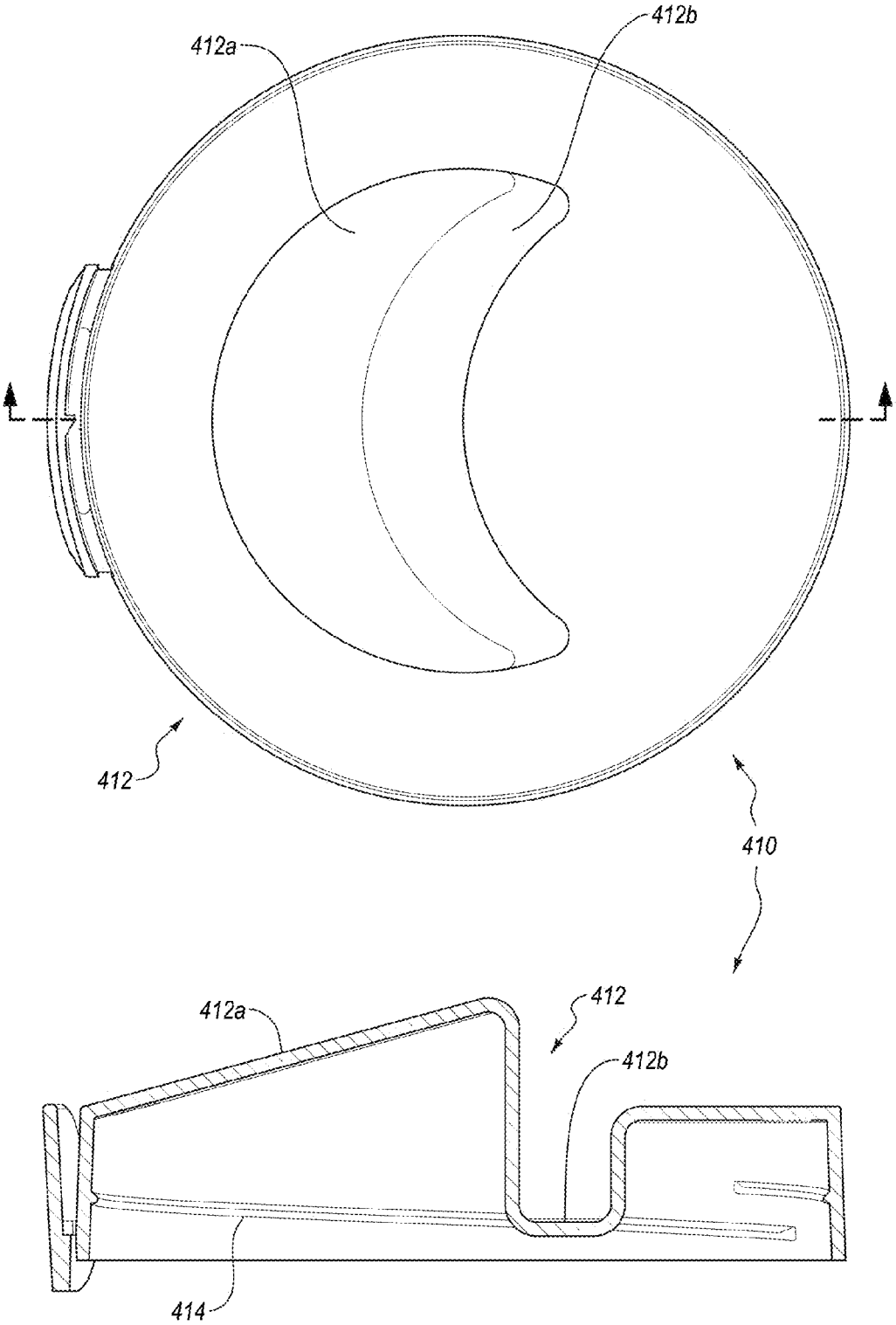
FIGS. 13*a*-13*c* are directed to further embodiments of a locking lid.
Figure 13B:
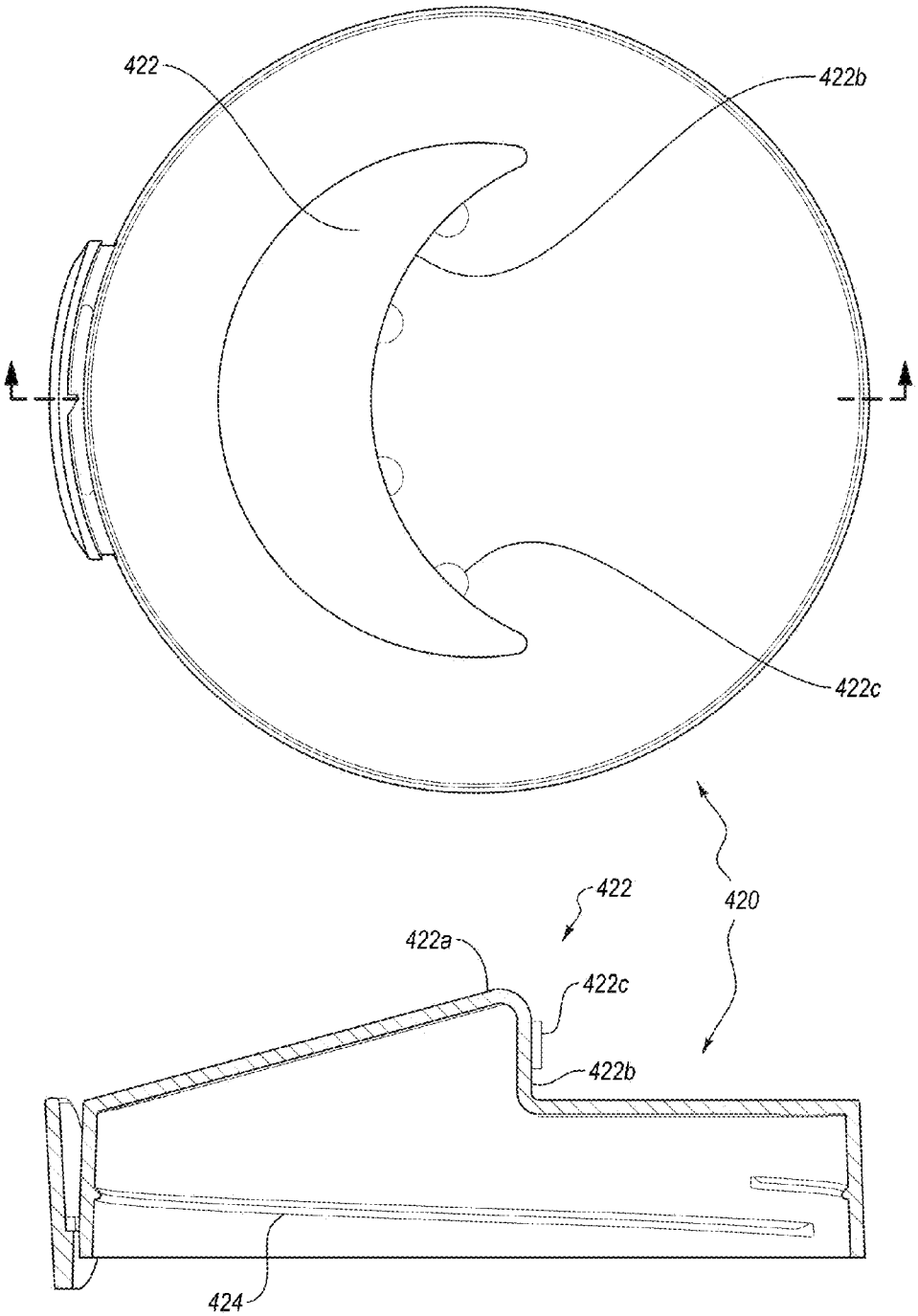
Figure 13C:
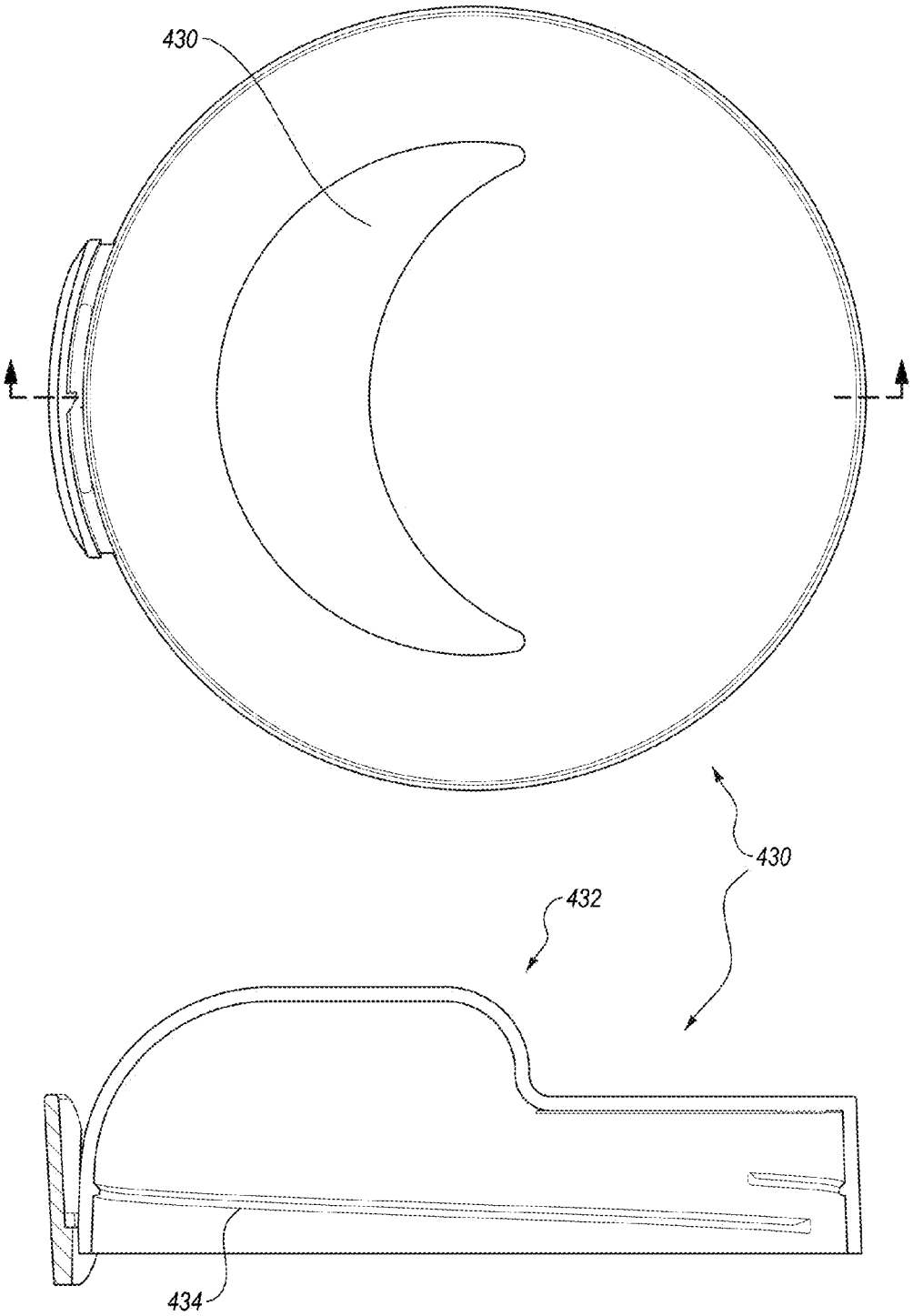

Turning now to FIGS. 13*a*-13*c*, additional example embodiments of a locking lid are disclosed. In general, the locking lids of FIGS. 13*a*-13*c* can each include one or more locking elements, such as one or more tabs, examples of which are disclosed herein. As such, the following discussion of FIGS. 13*a*-13*c* is primarily directed to various implementations of a grip element. The first of the example locking lids disclosed in FIG. 13*a* is denoted generally at 410 and includes a grip element 412 that includes both a raised portion 412*a* and a recess 412*b*. As well, the locking lid 410 may include threads 414.

Another of the example locking lids in FIG. 13*b* is denoted generally at 420 and includes a grip element 422 that includes a raised portion 422*a* but not recesses. In some embodiments, the grip element 422 can include a grip surface 422*b* that includes vertical ridges 422*c* and/or other elements that enable a user to better grasp and retain the grip element 422. As well, the locking lid 410 may include threads 424.

Elements such as the vertical ridges 422*c* can be employed in any of the other disclosed embodiments as well. As an alternative to the vertical ridges 422*c*, or in addition, a grip surface such as grip surface 422*b* can be textured, such as by roughening for example, or include any other surface treatment that may improve grip by a user. The surface treatment can be formed, for example, as part of the manufacture of the lid.

With reference to FIG. 13*c*, another example of a locking lid is denoted generally at 430. In general, the lid 430 may be the same as the locking lid 420 except that the lid 430 is directed more generally to any shape of a raised configuration for a grip element 432. The locking lid 430 may also include threads 434.

Figure 14:
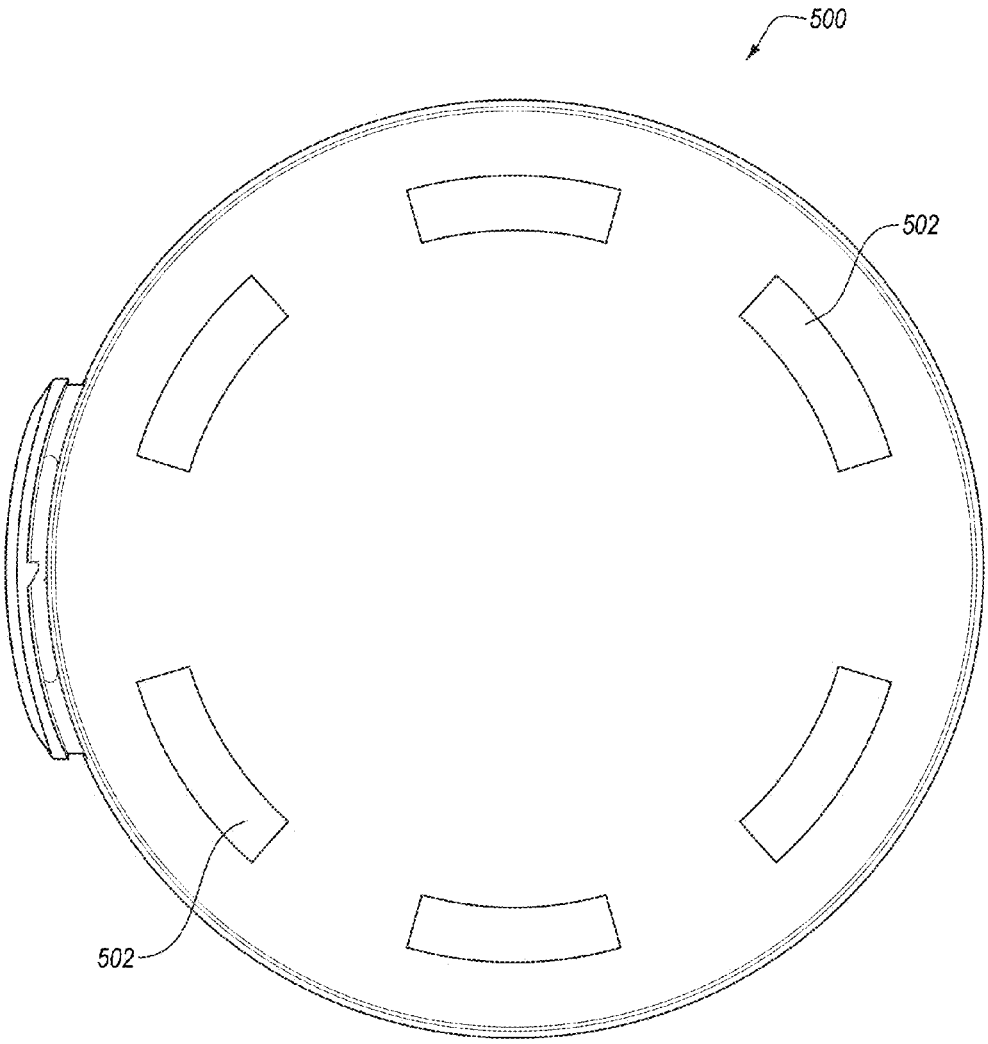
FIG. 14 is directed to an embodiment of a lid that includes multiple grip elements.

With reference now to FIG. 14, another example embodiment of a lid is denoted generally at 500. While the lid 500 is illustrated as a non-locking lid, it should be understood that the following discussion is germane to a locking lid also. As such, the lid 500 can include one or more locking elements, such as the tabs disclosed herein. In some embodiments at least, the lid 500 may be relatively large, such that some users may find it difficult to attach or remove the lid 500, even where a grip element such as is disclosed herein is employed. Thus, for example, the lid 500 could be about the size of a lid that may be used to cover a 5 gallon container, such as a paint bucket. In view of the relatively large size of the lid 500, multiple grip elements 502 are provided. This configuration may make it easier for a user to attach and remove the lid 500.

In general, the grip elements 502 can be configured and arranged such that a user is able to simultaneously grasp two of the grip elements 502, one with either hand, and attach/remove the lid 500. Thus, two of the grip elements 502 may be relatively close to each other in terms of their respective angular positions with regard to the circumference of the lid 500. Groups of grip elements 502 can be employed that may be equally angularly spaced about the circumference of the lid 500, although such equal spacing is not required. Such groups can include one, two, or more grip elements 502, and any number of groups can be employed. In some example embodiments, three groups are used, but more or fewer groups can alternatively be used. The grip elements 502 can take any of the configurations disclosed herein and in some embodiments, the grip elements 502 all have the same configuration while, in other embodiments, respective grip elements 502 may have different configurations within a single lid 500.

It should be noted that the general aspect ratios and related information disclosed herein at, for example, FIG. 7, as well as the related discussion, apply as well to the alternative embodiments depicted in FIGS. 12-14. As well, although the embodiments of FIGS. 12-14 each indicate grip elements in a lid that include only a single raised portion and/or recess, it should be understood that any of those grip elements can include multiple raised portions and/or recesses.

Directing attention finally to FIGS. 15*a*-15*d*, details are provided concerning various alternative embodiments of a container. Except as noted in the following discussion, the example container configurations set forth in FIGS. 15*a*-15*d* can be similar, or identical to, any of the other container embodiments disclosed herein. Similarly, any of the lids disclosed herein, whether non-locking or CRC-type, can be used with any of the container embodiments disclosed in FIGS. 15*a*-15*d*. Finally, the grip elements respectively disclosed in FIGS. 15*a*-15*d*, can be integrally formed with an associated container.

Figure 15A:
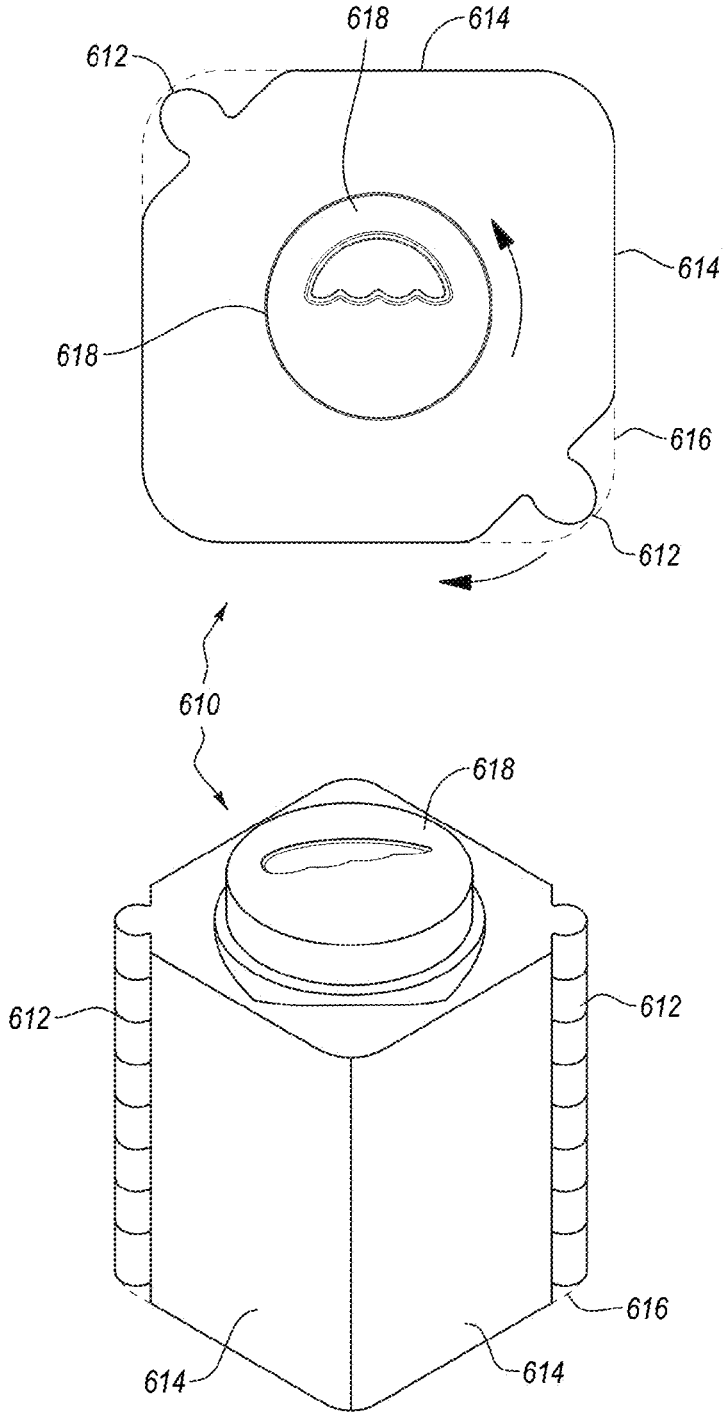
FIGS. 15*a*-15*d* are directed to further example embodiments of a container.

The first example container 610, indicated in FIG. 15*a*, includes one or more grip elements 612 that extend outwardly from a side surface 614 of the container and are configured such that they can be gripped by a user. However, although the grip elements 612 extend out a distance from one or more of the side surfaces 614 container 610, the grip elements 612 nonetheless remain within inside the container 610 envelope 616. That is, the grip elements 612 do not extend beyond the maximum overall boundaries defined by the container 610. Thus, the grip elements 612 enable desirable functionality in the container 610, but without increasing the overall size of the container 610.

In the example of FIG. 15*a*, two grip elements 612 are provided that are about 180 degrees apart from each other. However, more, or fewer, grip elements 612 can be provided in other embodiments. For example, one, three, or four, grip elements 612 can be provided. As well, the spacing between grip elements 612 can be equal, or non-equal. Finally, the configuration of the grip elements 612 can be such that they have a generally elongate cross-section when viewed from above, as in the example of FIG. 15*a*, although any other configuration of grip elements 612 can be employed. In operation, a user can grasp a grip element 612 with one hand, and the lid 618 with the other. By then turning the lid 618 in the desired direction, the lid 618 can be attached to, or removed from, the container 610 as needed.

Figure 15B:
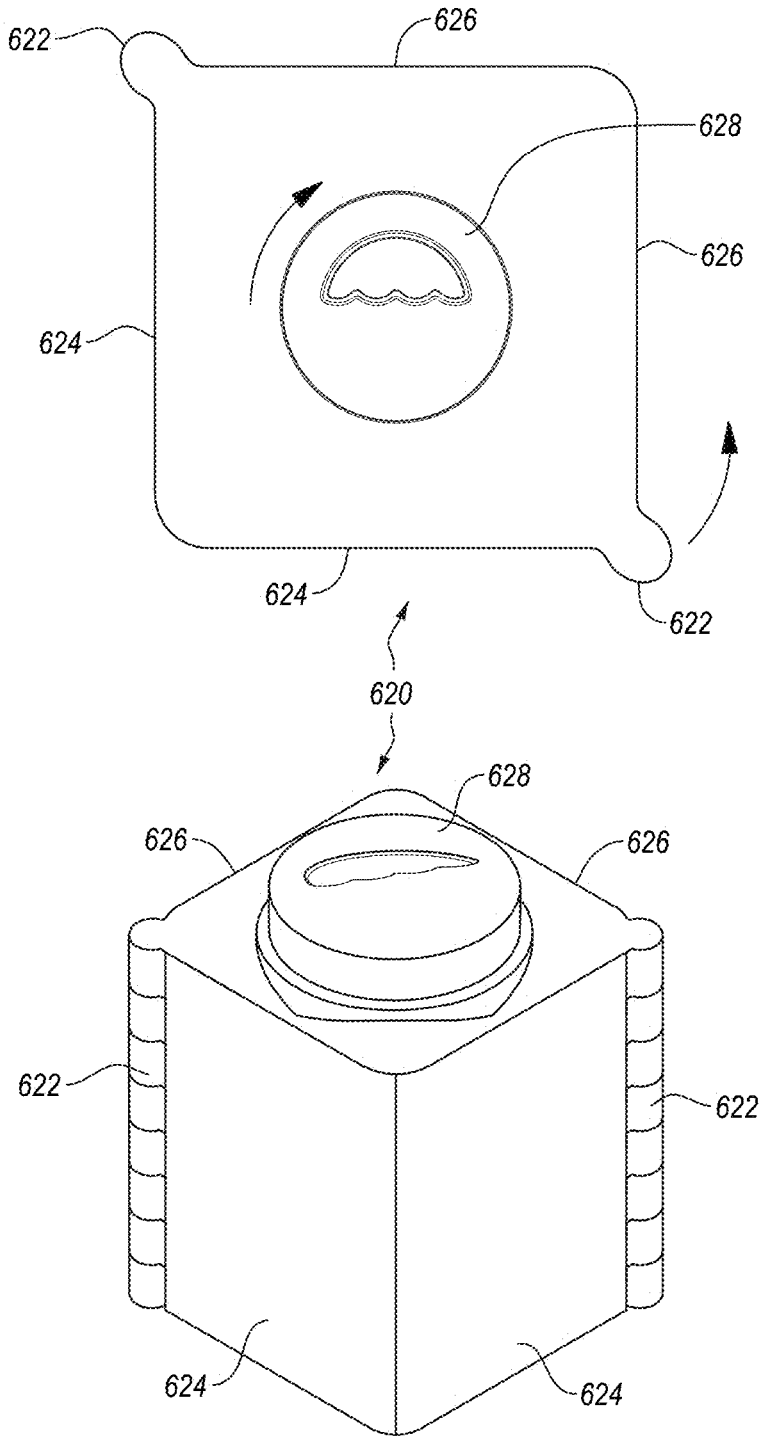

The second example container 620, indicated in FIG. 15*b*, is similar to the embodiment of FIG. 15*a* in that the container 620 includes one or more grip elements 622 that extend outwardly from a side surface 624 of the container 620 and are configured such that they can be gripped by a user. In contrast with the embodiment of FIG. 15*a* however, the grip elements 622 of the container 620 extend out a distance beyond the envelope 626 of the container 620. That is, the grip elements 622 extend beyond the maximum overall boundaries defined by the container 620. In other respects however, the grip elements 622 can be similar to the grip elements 612. For example, the size, number, configuration and/or orientation of the grip elements 622 can be similar, or identical, to the grip elements 612. Operationally, the container 620 and lid 628 can function in the same way as the container 610 and lid 618.

Figure 15C:
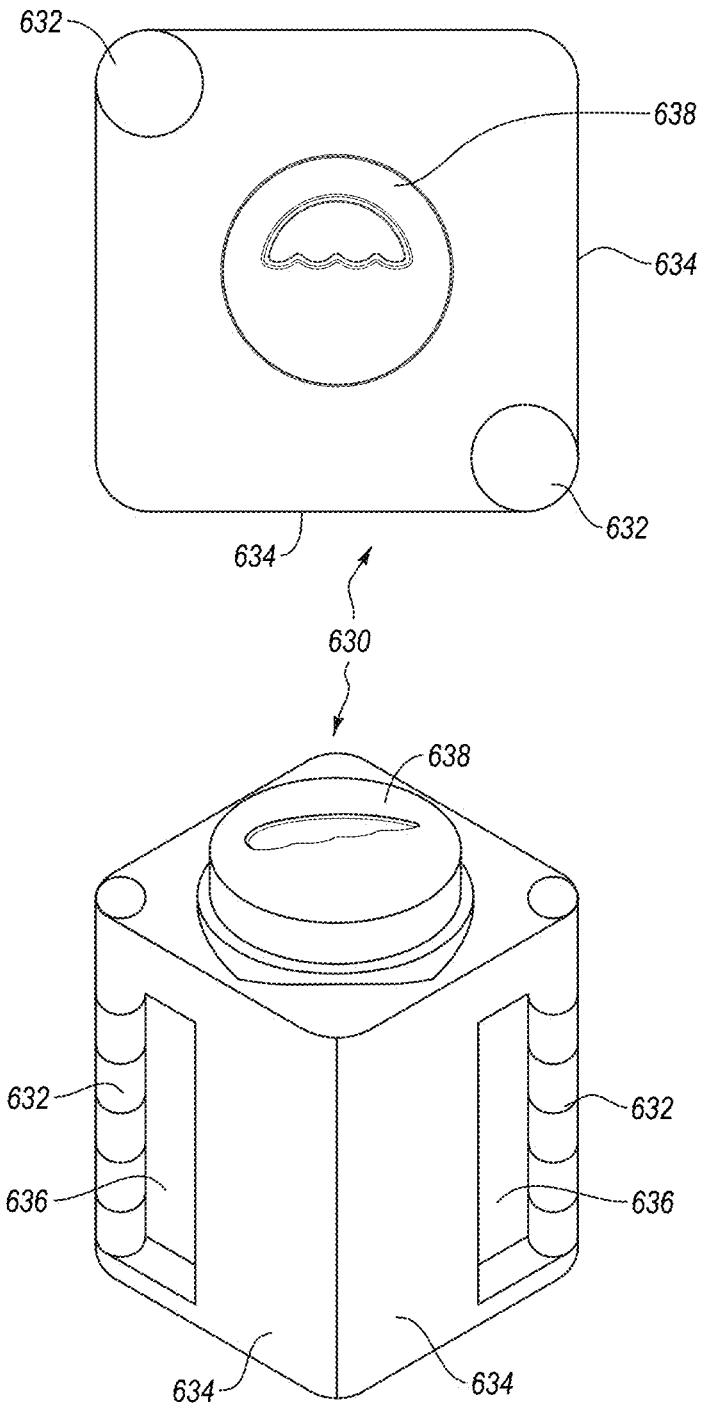

With attention now to FIG. 15*c*, a container 630 is provided that may include one or more grip elements 632. The grip elements 632 can be arranged similar to the grip elements 612 in that the grip elements 632 do not extend, or only slightly extend, beyond the overall envelope 634 of the container 630. In the example of FIG. 15*c*, the grip elements 632 can take the form of handles configured and arranged such that a space 636 is provided between the main body of the container 630 and the grip element 632. In other respects however, the grip elements 632 can be similar to the grip elements disclosed in FIGS. 15*a* and 15*b*. For example, the size, number, configuration and/or orientation of the grip elements 632 can be similar, or identical, to the grip elements 612 or 622. Operationally, the container 630 and lid 638 can function in the same way as the containers and lids respectively disclosed in FIGS. 15*a* and 15*b*.

Figure 15D:
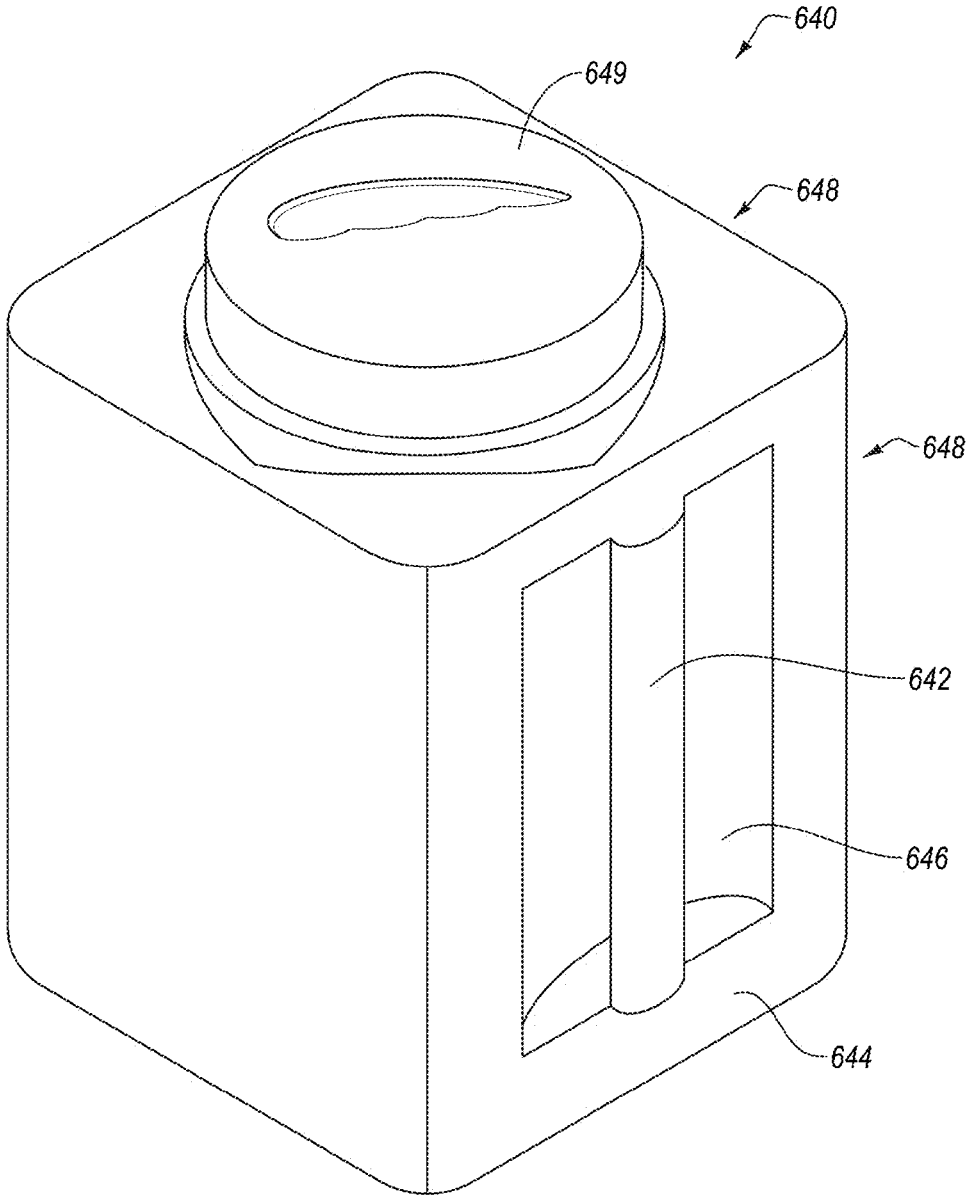

Turning now to FIG. 15*d*, another alternative embodiment of container is denoted generally at 640. In the example of FIG. 15*d*, the container 640 includes one or more grip elements 642 disposed in a surface 644 of the container 640. In this embodiment, the grip element 642 can be disposed proximate a recess 646 defined in the surface 644 of the container such that space is defined between the grip element 642 and the recess, enabling the grip element 642 to serve as a handle. As such, the grip element 642 does not extend, or only slightly extends, beyond the overall envelope 648 defined by the container 640. In various respects, the grip element 642 can be similar to the grip elements disclosed in any of FIGS. 15*a*-15*c*. For example, the size, number, configuration and/or orientation of the grip elements 642 can be similar, or identical, to the grip elements respectively disclosed in FIGS. 15*a*-15*c*. Operationally, the container 640 and lid 649 can function in the same way as the containers and lids respectively disclosed in FIGS. 15*a* and 15*b*.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed:

1. A lid configured for use with a container, comprising:

an upper surface that is generally circular in shape;

a side wall with an annular configuration, the side wall intersecting the upper surface to define an edge of the lid;

a grip element extending downward from the upper surface and sized and configured to be grasped by a user, and the grip element including a grip portion comprising a single recess that includes a plurality of curved indentations, each of which is configured to accommodate part of a finger of a user, and the grip portion is set back a distance from the edge of the lid; and a tab attached to the side wall of the lid by an elastically deformable standoff element, wherein the tab and the grip element are disposed opposite each other proximate respective portions of the edge of the lid.

2. The lid as recited in claim 1, wherein the grip element and the tab are positioned so that when the fingers of the user are positioned in the curved indentations of the recess, a palm of the user is positioned proximate the tab.

3. The lid as recited in claim 2, wherein a depth of the recess is uniform throughout the recess.

4. The lid as recited in claim 1, wherein the grip element and the tab are disposed about 180 degrees apart from each other.

5. The lid as recited in claim 1, wherein the side wall has an inner surface that is threaded.

6. The lid as recited in claim 1, wherein a distance between the grip portion of the grip element and an outer surface of the tab is substantially less than a diameter of the lid.

7. The lid as recited in claim 1, wherein a distance between the grip portion of the grip element and an outer surface of the tab is in a range of about ⅜ of a diameter of the lid to about ⅝ of the diameter of the lid.

8. The lid as recited in claim 1, wherein the standoff element at least partly defines an axis about which the tab is rotatable.

9. The lid as recited in claim 1, wherein the lid includes an engagement element configured and arranged to releasably engage a corresponding engagement element of a container.

10. An apparatus, comprising:

a container, comprising:

one or more walls, and a bottom and a top connected with the walls;

a mouth connected with the top and including threads;

a plurality of engagement elements; and a lid, comprising:

an upper surface that is generally circular in shape;

a side wall with an annular configuration, the side wall intersecting the upper surface to define an edge of the lid, and an inner surface of the side wall including threads configured to engage the threads of the container;

a tab attached to the side wall of the lid and including an engagement element configured to releasably engage the engagement elements of the container; and a grip element extending downward from the upper surface and sized and configured to be grasped by a user, and the grip element including a grip portion comprising a single recess that includes a plurality of curved indentations, each of which is configured to accommodate part of a finger of a user, and the grip portion is set back a distance from the edge of the lid, wherein the grip element and the tab are disposed opposite each other proximate respective portions of the edge of the lid.

11. The apparatus as recited in claim 10, wherein the grip element and the tab are positioned so that when the fingers of the user are positioned in the curved indentations of the recess, a palm of the user is positioned proximate the tab.

12. The apparatus as recited in claim 10, wherein the tab and the grip element are disposed about 180 degrees apart from each other.

13. The apparatus as recited in claim 10, wherein the upper surface of the lid is flat and a depth of the recess of the grip element is uniform throughout the recess, and a plurality of walls defining the recess are vertical.

14. The apparatus as recited in claim 12, wherein a distance between an inner wall of the grip portion of the grip element and an outer surface of the tab is less than a diameter of the lid.

15. The apparatus as recited in claim 12, wherein when the lid is locked to the container, movement of an upper edge of the tab toward the side wall of the lid unlocks the engagement element of the tab from an engagement element of the container so that the lid is free to rotate relative to the container.

16. The apparatus as recited in claim 10, wherein the plurality of engagement elements comprises first and second sets of engagement elements located proximate a perimeter of a portion of the container and spaced apart from each other about a perimeter of the portion, and the first and second sets of engagement elements collectively define three or more different locking positions.

* * * * *